US007349824B2

(12) United States Patent
Seigel

(10) Patent No.: US 7,349,824 B2
(45) Date of Patent: Mar. 25, 2008

(54) METHOD AND SYSTEM FOR EVALUATING THE EFFICIENCY OF AN AIR CONDITIONING APPARATUS

(75) Inventor: Lawrence J. Seigel, Alpharetta, GA (US)

(73) Assignee: Chillergy Systems, LLC, Canton, GA (US)

( * ) Notice: Subject to any disclaimer, the term of this patent is extended or adjusted under 35 U.S.C. 154(b) by 0 days.

(21) Appl. No.: 11/183,582

(22) Filed: Jul. 18, 2005

(65) Prior Publication Data

US 2005/0251293 A1 Nov. 10, 2005

Related U.S. Application Data

(63) Continuation of application No. 10/034,785, filed on Dec. 27, 2001, now Pat. No. 6,973,410.

(60) Provisional application No. 60/291,248, filed on May 15, 2001.

(51) Int. Cl.
*G06F 17/00* (2006.01)

(52) U.S. Cl. ..... 702/182; 702/183; 700/276; 62/125; 62/127

(58) Field of Classification Search ..... 702/130, 702/182, 35, 36, 50, 51, 105, 113, 114, 136, 702/138, 140, 187, 188, 183–185; 700/26, 700/275–278, 299, 300, 83; 417/63, 32, 417/53; 62/228.1, 129, 132, 125–127, 231; 236/34, 910, 16, 46 R
See application file for complete search history.

(56) References Cited

U.S. PATENT DOCUMENTS 3,707,851 A * 1/1973 McAshan, Jr. ..... 62/125
4,325,223 A * 4/1982 Cantley ..... 62/126
4,483,152 A * 11/1984 Bitondo ..... 62/175
4,611,470 A * 9/1986 Enstrom ..... 62/127
4,732,008 A * 3/1988 DeVault ..... 62/79
4,768,346 A 9/1988 Mathur ..... 62/127
5,083,438 A * 1/1992 McMullin ..... 62/129
5,596,507 A * 1/1997 Jones et al. ..... 700/276
5,623,426 A * 4/1997 Ozawa et al. ..... 702/99
5,677,677 A * 10/1997 Duff et al. ..... 340/585
5,684,463 A * 11/1997 Diercks et al. ..... 340/584

(Continued)

OTHER PUBLICATIONS

Figueroa, "A Thermodynamic Model of Water Cooled Centrifugal Chillers", May 1997, Texas A&M University-Kingsville, pp. iii-xvi, 1-63.*

(Continued)

*Primary Examiner*—Hal Wachsman
(74) *Attorney, Agent, or Firm*—Weatherly Kerven & Seigel LLC; David S. Kerven; Mitchell G. Weatherly

(57) ABSTRACT

The applicant describes a system and methods of calculating the overall operating efficiency of an air conditioning chiller that evaluates efficiency of the component parts of the chiller and generates an overall efficiency based on these component efficiency values. If the overall chiller efficiency is less than the maximum attainable chiller efficiency, the cost of the inefficiency is calculated and presented to the user. Recommendations for corrective action to restore maximum chiller efficiency are identified and presented to the user. The system also adjusts the efficiency calculations as appropriate to account for actual compressor current load conditions.

28 Claims, 27 Drawing Sheets

U.S. PATENT DOCUMENTS 5,963,458 A * 10/1999 Cascia ..... 700/300
6,185,946 B1 * 2/2001 Hartman ..... 62/175
6,430,937 B2 * 8/2002 Cho et al. ..... 62/5
6,438,981 B1 * 8/2002 Whiteside ..... 623/228.1
6,505,475 B1 * 1/2003 Zugibe et al. ..... 62/192
6,532,754 B2 * 3/2003 Haley et al. ..... 62/129
6,581,399 B2 * 6/2003 Benedict et al. ..... 62/228.1
6,658,373 B2 * 12/2003 Rossi et al. ..... 702/185
6,668,240 B2 * 12/2003 Singh et al. ..... 702/188
6,701,725 B2 * 3/2004 Rossi et al. ..... 62/125
6,892,546 B2 * 5/2005 Singh et al. ..... 62/127
7,093,455 B2 * 8/2006 Holtzapple et al. ..... 62/268
2001/0042380 A1 * 11/2001 Cho et al. ..... 62/238.2
2002/0055358 A1 * 5/2002 Hebert ..... 455/423
2002/0157405 A1 * 10/2002 Haley et al. ..... 62/127
2002/0184905 A1 * 12/2002 Benedict et al. ..... 62/228.4

OTHER PUBLICATIONS

Wall, "Optimization of refrigeration machinery", Nov. 1991, International Journal of Refrigeration, vol. 14, No. 6, pp. 336-340.*

* cited by examiner

CONT'D ON FIG.5-1

CHILLERCHECK.COM

ChillerCheck Main | Daily Report | Most Recent Readings | Add Location | Add User | Edit Users | Download Palm Application 82 84 Add a Chiller at Atlanta Office Bldg. 80 86 88 90

Please fill in all information in the form below, then click the "Add Chiller" button.

You will then be taken back to the ChillerCheck Main page, where you can work with any of your Location, Chiller or Chiller Log records.

Note: If you do not have all the information below available at this time, you can still add the Chiller by filling out only the required information (marked with an * below) now. You can come back later and add the rest of the information. However, you will not be able to make efficiency calculations or graph trends until all Chiller information has been recorded.

Chiller Information

| | |
|---|---|
| Help! * Chiller #: | 96 |
| * Make: | Choose a Make 98 |
| Help! * Model: | 100 |
| Help! Serial #: | 102 |
| Help! * Refigerant Type: | Choose a refrigerant 104 |
| Help! Year Chiller Was Manufactured: | Choose a year of manufacture 106 |
| Help! * Efficiency Rating (kw/ton): | 108 |
| Help! *Energy Cost ($/kw hour): | 110 |

FIG. 6A

| | |
|---|---|
| Help! * Weekly Hrs. of Operation: | 112 |
| Help! * Weeks Per Year of Operation: | 114 |
| Help! * Average Load Profile: | % 116 |
| Help! * Tons: | 118 |
| Help! * Design Voltage: | 120 |
| Help! * Full-Load Amperage: | 122 |
| *Now we need some information about the Condenser.* | |
| Help! Design Condenser Water Pressure Drop: (This value may be omitted if necessary, but your calculations will be more accurate if you have it. If you enter a value, you must choose a unit of measure.) | 124 Choose a pressure unit 126 |
| Help! Please choose a unit of measurement for the Actual Condenser Water Pressure Drop: | Choose a pressure unit 128 |
| Help! Please choose a unit of measurement for Condenser Pressure: | Choose a pressure unit 130 |
| Design Condenser Approach Temp: (This Value may be omitted if you do not have it.) | 132 |

FIG. 6B

CONT'D FROM FIG.7

CONT'D FROM FIG.7

| | | | | | | | | | | | | | | | | | | | | | | | | | |
|---|---|---|---|---|---|---|---|---|---|---|---|---|---|---|---|---|---|---|---|---|---|---|---|---|---|
| Location: Main Chiller Plant Chiller #: 1 | | | | | | | | | | | | | | | | | | | | | | | | | |
| 8/24/01 TP 9:08 AM Eff. Loss: 10.8% % Load: 57.9% | 74.0 | 81.0 | 82.0 | 0.0 | 4.0 | 1.8 | 10.0 | 49.0 | 39.0 | 38.0 | 0.0 | -16.0 | 10.0 | 25.8 | 140 | 50 | 123 | 123 | 123 | 620 | 620 | 620 | 480 | 480 | 480 |
| Location: Main Chiller Plant Chiller #: 2 | | | | | | | | | | | | | | | | | | | | | | | | | |
| 8/21/01 TP 8:00 AM Eff. Loss: 35.6% % Load: 87.0% | 78.0 | 82.0 | 84.0 | 0.3 | 10.0 | 7.1 | | 50.0 | 44.0 | 42.0 | 0.0 | -12.0 | | 17.9 | 150 | 50 | 123 | 12345 | 123 | 500 | 500 | 500 | 480 | 480 | 480 |
| Location: Main Chiller Plant Chiller #: 3A | | | | | | | | | | | | | | | | | | | | | | | | | |
| 8/21/01 TP 8:00 AM Eff. Loss: 4.0% % Load: 42.4% | 73.7 | 80.7 | 81.0 | 0.0 | -0.5 | -0.2 | | 47.8 | 38.0 | 36.0 | 0.5 | -8.8 | | 19 | 139 | 50 | 124 | 12345 | 123 | 443 | 450 | 460 | 480 | 480 | 480 |

Done

Internet

FIG. 7-1

CONT'D FROM FIG.8

CONT'D FROM FIG.8

| | | | | | | | | | | | | | | | | | | | | | | |
|---|---|---|---|---|---|---|---|---|---|---|---|---|---|---|---|---|---|---|---|---|---|---|
| 7/3/01 DU 2:42 PM Eff. Loss: 13.3% % Load: 77.9% | 78.7 | 85.8 | 90.2 | 4.6 | 168.0 | −0.9 | 10.0 | 51.9 | 41.7 | 38.0 | 2.0 | 65.5 | 14.0 | 20.0 | 138 | 60 | 30290.0 | 850 | 888 | 886 | 480 | 480 | 480 |
| 7/2/01 DU 1:42 PM Eff. Loss: 14.3% % Load: 83.3% | 77.0 | 83.3 | 88.4 | 5.1 | 163.0 | −1.3 | 10.0 | 51.7 | 42.0 | 38.0 | 2.0 | 65.5 | 20.0 | 20.0 | 135 | 50 | 30240.0 | 925 | 950 | 950 | 480 | 480 | 480 |
| 6/27/01 DU 2:58 PM Eff. Loss: 16.5% % Load: 79.0% | 77.7 | 83.3 | 88.4 | 5.5 | 163.0 | −1.3 | 10.0 | 51.4 | 42.4 | 38.0 | 2.8 | 65.5 | 19.0 | 20.0 | 135 | 50 | 30170.0 | 898 | 900 | 901 | 480 | 480 | 480 |
| 6/26/01 DU 12:06 PM | 78.5 | 84.5 | 87.9 | 4.5 | 163.0 | 0.0 | 10.0 | 49.8 | 42.3 | 38.5 | 4.3 | 65.5 | 14.0 | | 135 | 60 | 30150.0 | 700 | 700 | 700 | 480 | 480 | 480 |

Done

Internet

FIG. 8-1

CHILLERCHECK.COM 170 172

ChillerCheck Main | Main Page for this Chiller | Add New Log Record | View Logsheet | Chart Trends Add a Log Record for Chiller #: 1 at Main Chiller Plant. 178

Please enter your readings into the form below, then click the "Add Record" button:

Log Record

| | | |
|---|---|---|
| Operator: | Tim | |
| Reading Date: | August 24, 2001 | 180 |
| Reading Time: | 9:32 AM | 182 |
| *Condenser Readings* | | |
| Inlet Water Temp: | °F | 184 |
| Outlet Water Temp: | °F | 186 |
| Refrigerant Temp: | °F | 188 |
| Condenser Pressure: | PSIG | 190 |
| Actual Condenser Water Pressure Drop: | PSIG | 192 |
| *Evaporator Readings* | | |
| Inlet Water Temp: | °F | 194 |
| Outlet Water Temp: | °F | 196 |
| Refrigerant Temp: | °F | 198 |
| Evaporator Pressure: | In. Hg. | 200 |
| Actual Chill Water Pressure Drop: | PSIG | 202 |

FIG. 11A

CHILLERCHECK.COM

ChillerCheck Main | Chiller #1 Main Page | Maint. Records | Add Maint. Record | Add Log Record | View Logsheet | Chart Trends Efficiency Calculation for Chiller #1 at Admin Bldg. 170 170 172
Reading taken on October 10, 2001 at 1:50 PM
163 165

Results

| | |
|---|---|
| Target Cost to Run for Year | $ 54,583 |
| Actual Cost to Run for Year | $ 65,993 |
| Cost of Efficiency Loss | $ 11,410 |
| Efficiency Loss | 20.9% |

Detailed Cost of Efficiency Loss

| Problem | Efficiency Loss | $ Cost | Solution |
|---|---|---|---|
| Fouled Tubes - Condenser | 9.5% | $ 5,187 | Fix it. |
| Non-condensables - Condenser | 11.4% | $ 6,222 | Fix it. |

232 232

Your Condenser Water Flow is 3.6% below design.

Your Evaporator Water Flow is 21.9% below design.

There is an electrical imbalance that may be decreasing the performance of your Chiller.
The voltage imbalance is 3.62%.

The % load at this reading time was 88.9%.

Back to the main page for this Chiller.

FIG. 12

CONT'D FROM FIG.16A

| Eddy Current Tests | |
|---|---|
| Eddy Current Test Date (Condenser): | Select a Month ▾ Day ▾ Year ▾ |
| Eddy Current Test Date (Evaporator): | Select a Month ▾ Day ▾ Year ▾ |
| **Major Stop Inspection (compressor teardown)** | |
| Major Stop Inspection: | Select a Month ▾ Day ▾ Year ▾ |
| **Refrigerant Maintenance** | |
| Refrigerant Analysis Date: | Select a Month ▾ Day ▾ Year ▾ |
| Date Refrigerant Added: | Select a Month ▾ Day ▾ Year ▾ |
| Quantity of Refrigerant Added: (Pounds): | |
| **Tube Cleaning** | |
| Condenser Tube Cleaning Date: | Select a Month ▾ Day ▾ Year ▾ |
| Evaporator Tube Cleaning Date: | Select a Month ▾ Day ▾ Year ▾ |
| **Purge Maintenance** | |
| Purge Tank Reclaim Date: | Select a Month ▾ Day ▾ Year ▾ |
| Purge Run Time Reading When Tank Reclaimed: | |

CONT'D ON FIG.16B

FIG. 16A-1

CHILLERCHECK.COM 178 170 172

ChillerCheck Main | Chiller #1 Main Page | Maint. Records | Add Maint. Record | Add Log Record | View Logsheet | Chart Trends Maintenance Records for Chiller #: 1 at Admin Bldg.
163 165

Below is a list of the most recent Maintenance Operations for your Chiller #1. You may click on the name of a Maintenance Type to view all records of that type.

| Maintenance Type | Most Recent Maintenance |
|---|---|
| Annual Maintenance: | October 18, 2001 |
| **Oil Maintenance** | |
| Oil Change: | October 18, 2001 |
| Oil Analysis: | October 1, 2001 |
| **Eddy Current Tests** | |
| Condenser Eddy Current: | September 9, 2001 |
| Evaporator Eddy Current: | September 10, 2001 |
| **Major Stop Inspection (compressor teardown)** | |
| Major Stop: | January 3, 2000 |

CONT'D ON FIG.17-1

FIG. 17

CONT'D FROM FIG.17

| Refrigerant Maintenance | |
|---|---|
| Refrigerant Analysis: | January 3, 2000 |
| Refrigerant Added: | August 23, 2001 – Quantity: 100 Pounds |
| **Tube Cleaning** | |
| Condenser Tube Cleaning: | October 19, 2001 |
| Evaporator Tube Cleaning: | February 5, 2000 |
| **Purge Maintenance** | |
| Purge Tank Reclaim: | February 7, 2001 – Purge Run Time at Change: 1212123 |
| **Major Repairs** | |
| Major Repair: | April 4, 2000<br>Repair Description: motor burnout |
| **Maintenance Notes** | |
| Notes: | November 5, 2001<br>Note: starter problems resulted in burnout |

FIG. 17-1

METHOD AND SYSTEM FOR EVALUATING THE EFFICIENCY OF AN AIR CONDITIONING APPARATUS

CROSS-REFERENCE TO RELATED APPLICATIONS

This application is a continuation of U.S. application Ser. No. 10/034,785, filed Dec. 27, 2001, now U.S. Pat. No. 6,973,410, which claims the benefit of U.S. Provisional Application No. 60/291,248, filed May 15, 2001, which is incorporated in this application in its entirety by this reference.

BACKGROUND OF THE INVENTION

1. Field of the Invention

The present invention relates generally to air conditioning system monitoring and, more specifically, to monitoring and evaluating the performance and efficiency of chiller units.

2. Description of the Related Art

The energy cost of operating an air conditioning system of the type used in high-rise and other commercial buildings can constitute the largest single cost in operating a building. Yet, unbeknownst to most building managers, such systems often operate inefficiently due to undesirable operating conditions that could be corrected if they were identified. When such conditions are identified and corrected, the cost savings can be substantial.

The type of air conditioning system referred to above typically includes one or more machines known as refrigeration units or chillers. Chillers cool or refrigerate water, brine or other liquid and circulate it throughout the building to fan-operated or inductive cooling units that absorb heat from the building interior. In the chiller, the liquid returning from these units passes through a heat exchanger or evaporator bathed in a reservoir of refrigerant. The heat exchanger transfers the heat from the returning liquid to the liquid refrigerant, evaporating it. A compressor, operated by a powerful electric motor, turbine or similar device, compresses or raises the pressure of the refrigerant vapor so that it can be condensed back into a liquid state by water passing through a condenser, which is another heat exchanger. The condenser water absorbs heat from the compressed refrigerant when it condenses on the outside of the condenser tubes. The condenser water is pumped to a cooling tower that cools the water through evaporative cooling and returns it to the condenser. The condensed refrigerant is fed in a controlled manner to the evaporator reservoir. The evaporator reservoir is maintained at a pressure sufficiently low as to cause the refrigerant to evaporate as it absorbs the heat from the liquid returning from the fan-operated or inductive units in the building interior. The evaporation also cools the refrigerant that remains in a liquid state in the reservoir. Some of the cooled refrigerant is circulated around the compressor motor windings to cool them.

It has long been known in the art that certain operating parameters are indicative of chiller problems and inefficient operation. It has long been a common practice for maintenance personnel to maintain a log book in which they periodically record readings from temperature and pressure gauges at the condenser, evaporator and compressor. Some chiller units are even equipped with computerized logging devices that automatically read and log temperatures and pressures from electronic sensors at the condenser.

Practitioners in the art have recognized that certain operating parameters can be used to compute a measure of chiller efficiency. For example, in U.S. Pat. No. 5,083,438, entitled "Chiller Monitoring System," it is stated that temperature and pressure sensors can be disposed in the inlet and outlet lines of a condenser and chiller unit to measure the flow rate through the chiller and the amount of chilling that occurs, and a sensor can be placed on the compressor motor to measure the power expended by the motor. From these measurements, an estimate of overall chiller efficiency can be computed.

Merely estimating chiller efficiency does not help maintenance personnel to improve efficiency or even recognize the true monetary cost of the inefficiency. For example, there are guidelines known in the art as to what operating ranges of a parameter are normal or acceptable and what ranges are indicative of correctable inefficient operation. Moreover, even if inefficient operation is recognized from abnormal temperature and pressure readings, there are few guidelines known in the art that maintenance personnel can use to diagnose and correct the cause of the inefficiency. Moreover, maintenance personnel must generally make personal, on-site inspections of the chiller and its log to gather the information. Sometimes considerable time can pass between such inspections.

It would be desirable to alert maintenance personnel to correctable chiller problems as soon as they occur and to provide greater guidance to such personnel for diagnosing and correcting problems. The present invention addresses these problems and deficiencies and others in the manner described below.

SUMMARY OF THE INVENTION

The present invention relates to evaluating the performance of an air conditioning chiller. Chiller operating parameters are input to a computing device that computes and outputs to maintenance or other personnel a measure of inefficiency at which the chiller is operating. In accordance with one aspect of the invention, a user can select which of a plurality of chillers to evaluate. The chillers may be located at different sites. In accordance with another aspect of the invention, chiller operating parameters are similarly input to a computing device that determines whether chiller efficiency is being compromised by poor performance of one or more chiller components and outputs an indication to maintenance or other personnel of a suggested remedial action to improve efficiency.

The operating parameters can be input manually by personnel who read gauges or other instruments or can be input automatically and electronically from sensors. The operating parameters can be input directly into the computing device that performs the evaluations or indirectly via a Web site interface, a handheld computing device or a combination of such input mechanisms. In some embodiments of the invention, such a handheld computing device can itself be the computing device that performs the evaluations.

As indicated above, the computing device can communicate information that relates to multiple chillers. The chillers can be installed at different geographic locations from one another. A user can select one of these chillers and, for the selected chiller, initiate any suitable operations, including, for example, inputting chiller operating parameters and other data, outputting a log record of collected chiller parameter data, and computing chiller efficiency.

It is to be understood that both the foregoing general description and the following detailed description are exemplary and explanatory only and are not restrictive of the invention, as claimed.

BRIEF DESCRIPTION OF THE DRAWINGS

The accompanying drawings illustrate one or more embodiments of the invention and, together with the written description, serve to explain the principles of the invention. Wherever possible, the same reference numbers are used throughout the drawings to refer to the same or like elements of an embodiment, and wherein:

FIG. 5-1 is a continuation of FIG. 5;

FIG. 6A depicts a screen for adding a chiller;

FIG. 6B is a continuation of FIG. 6A;

FIG. 7-1 is a continuation of FIG. 7;

FIG. 8-1 is a continuation of FIG. 8;

FIG. 11A depicts a screen via which a user can enter chiller readings;

FIG. 12 depicts a screen showing the results of an efficiency loss computation for a selected chiller;

FIG. 16A-1 is a continuation of FIG. 16A;

FIG. 17 depicts a screen showing maintenance records; and

FIG. 17-1 is a continuation of FIG. 17.

DETAILED DESCRIPTION

Figure 1:
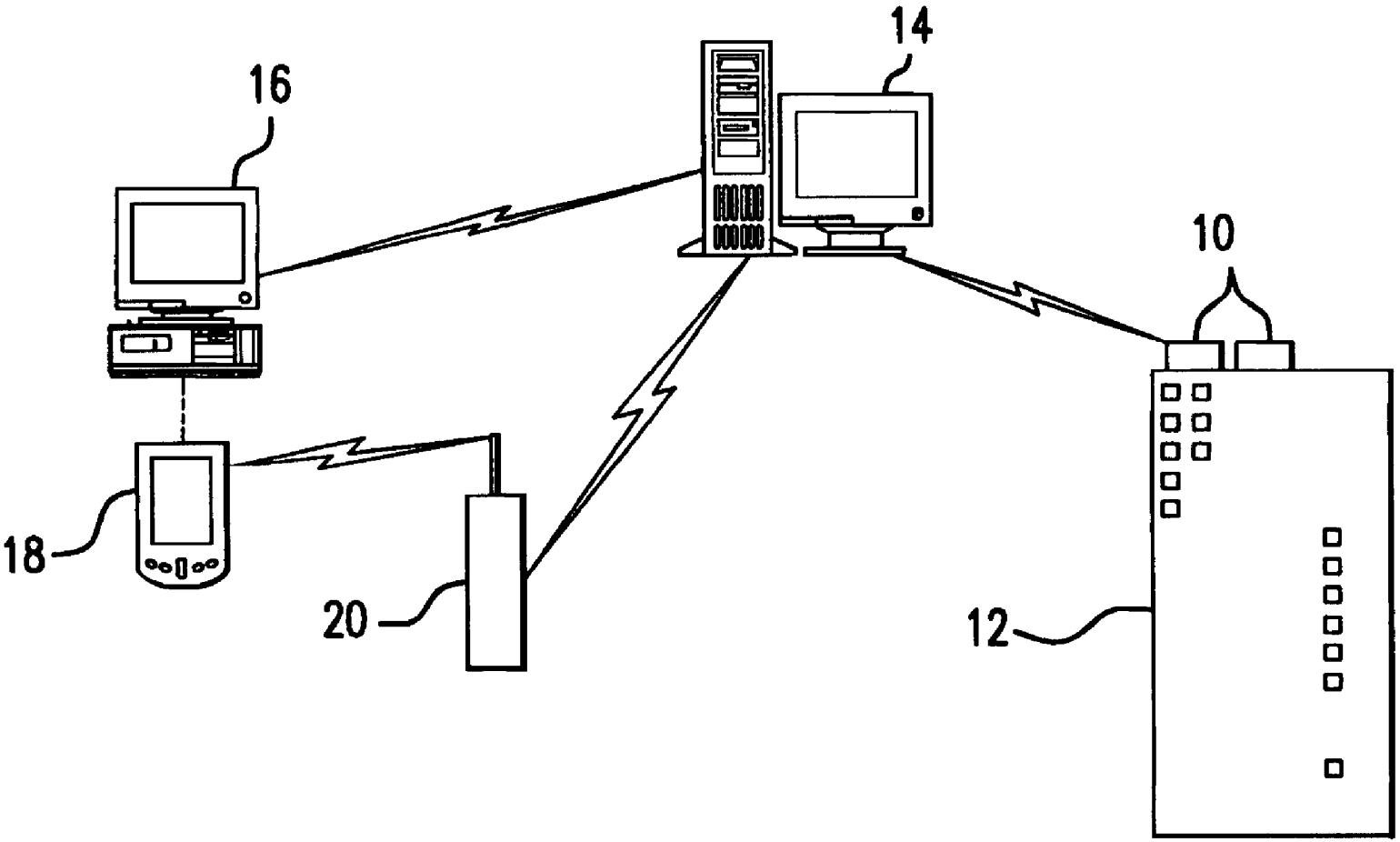
FIG. 1 illustrates a system for evaluating an air conditioning chiller via a remote computer.

As illustrated in FIG. 1, two or more chillers 10 are installed on a building 12. As described below, a person responsible for maintaining chillers 10 or other person having an interest in their efficiency can use the system of the present invention to evaluate the efficiency at which they are operating and whether maintenance of any chiller components may improve operating efficiency.

Each of chillers 10 can communicate data with a server computer 14. A client computer 16, located remotely from server computer 14, can communicate data with server computer 14 via a network such as the Internet or a portion thereof. Also illustrated is a portable or handheld data device 18 that can be docked or synchronized with client computer 16 to communicate data with it or, alternatively or in addition, that can communicate with server computer 14 via a wireless network service 20. Server computer 14 can communicate not only with chillers 10 but also in the same manner with other chillers (not shown) that may be installed on other buildings (not shown) at other geographic locations. Server computer 14 can be located at any suitable site and can be of any suitable type.

Figure 2:
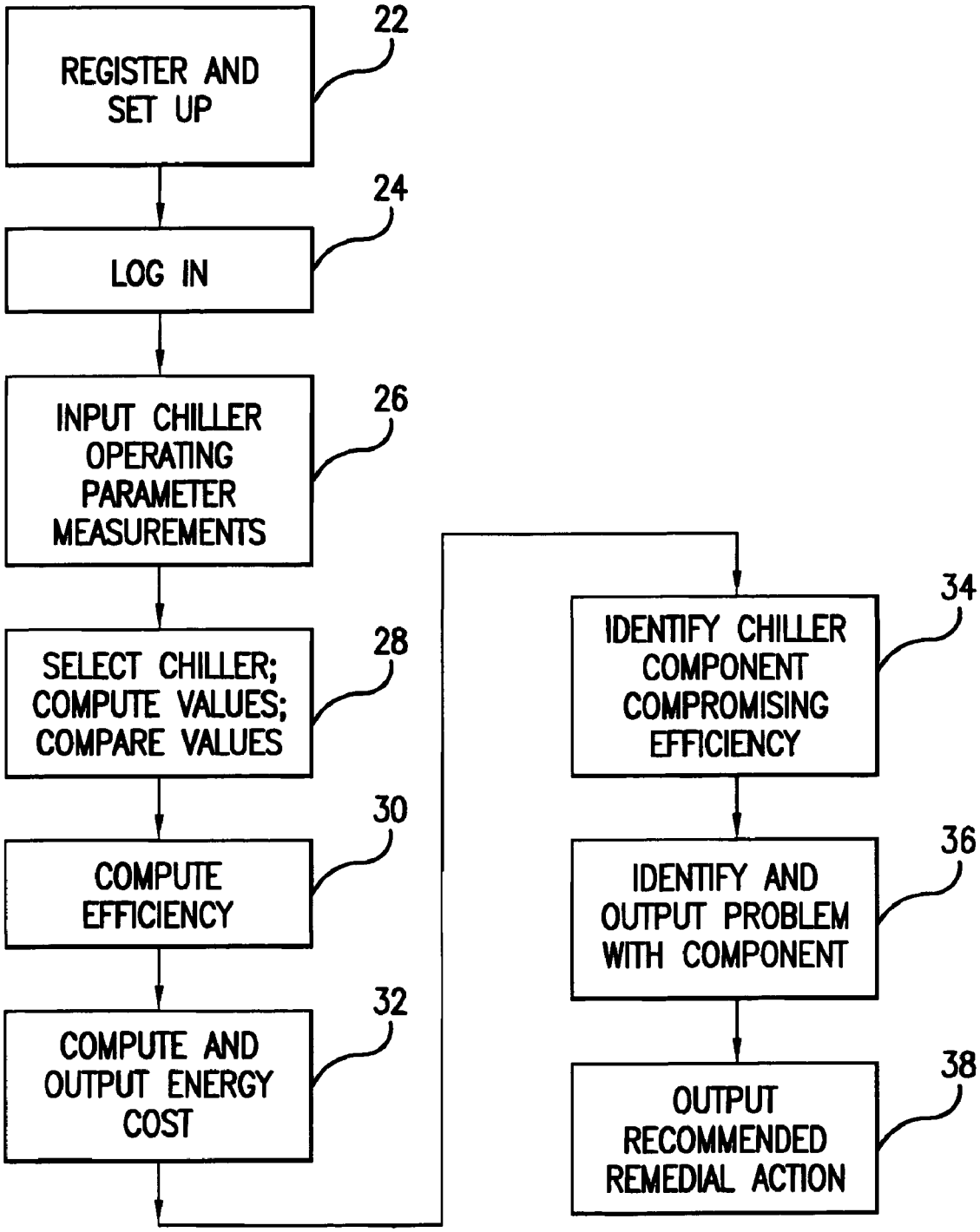
FIG. 2 is a flow diagram illustrating a generalized method for evaluating chiller efficiency.

A generalized method by which the invention operates is illustrated in FIG. 2. At step 22 a user registers for a service or otherwise provides one-time information necessary to set up the system for use. The system can be administered by the user himself (the user being an individual acting on his own behalf or on behalf of a business entity) or by another party that charges the user for the service of monitoring and evaluating the user's chillers 10. It is contemplated that server computer 14 in conjunction with client computer 16 effect these method steps in some embodiments of the invention and that handheld data device 18 effect some or all of the method steps in other embodiments. In other words, either or both of server computer 14 and handheld data device 18 can serve as the computational or algorithmic engine behind the illustrated method or process. Handheld data device 18 can communicate with chillers 10 via server computer 14 as in the illustrated embodiment or communicate directly with chillers 10 in other embodiments. The party charging the user for the evaluation service can operate server computer 14, and a user can register with the service by using client computer 16 or handheld data device 18 to log onto server computer 14 and supply requested information regarding the user and chillers 10, as described in further detail below. Information regarding chillers 10 can include constant or fixed values such as those specified by the chiller manufacturer, including the maximum compressor load, condenser approach, evaporator approach, the age of the chiller, the type of refrigerant used in the chiller, the optimal condenser pressure, the optimal condenser pressure drop, the optimal outlet water temperature for the chiller, and so forth. These values and similar information regarding chillers 10 are predetermined, i.e., known in advance of their use in the invention. In this manner, the evaluation service can sign up many users, each of whom has one or more chillers 10 he or she would like the service to monitor and evaluate in the manner described below. Each user can set up the system to monitor one or more chillers 10, which can be installed in the same building 12 as each other or on different buildings. Each user can use a client computer 16 or handheld data device 18 to communicate with server 14.

Note that FIG. 2 represents steps that occur through the interaction of the user with the computing device or devices, such as server computer 14, client computer 16 and handheld data device 18. In view of the flow diagrams and other teachings in this patent specification, persons skilled in the art to which the invention relates will readily be capable of programming such computing devices or otherwise providing suitable software to effect the described methods.

Once a user is registered with the service, at step 24 the user can log into server computer 14 at any time, again using either client computer 16 or handheld data device 18. Note that step 24 need not be performed in all embodiments of the invention because in some embodiments handheld data device 18 may include all the computational capability of the invention necessary to perform the remaining steps. At step 26 chiller operating parameters are input. This step can comprise the user reading gauges or meters or the like that are connected to chiller 10 and manually entering the information using client computer 16 or handheld data device 18. Alternatively, it can comprise server 14 automatically and electronically reading data-logging sensors connected to chiller 10. In still other embodiments of the invention, some parameters can be entered manually and others read automatically.

It should be noted that the method steps shown in FIG. 2 can occur in any suitable order and at any suitable time. For example, step 26 in which operating parameters are input can occur at any time. Manually-entered parameters can be input at such time as the user may schedule a maintenance visit to building 12. Automatically-entered parameters can be input on a periodic basis or at certain times of day under control of a software timer or clock.

At step 28, the user selects one of chillers 10. As described in further detail below with regard to the user interface, indications identifying chillers 10 from which the user can choose, such as a user-assigned chiller name or number, can be displayed to aid the user in this selection step. The parameter measurements that have been input for the selected chiller 10 or, in some embodiments of the invention, values derived therefrom through formulas or other computations, are compared to predetermined values that have been empirically determined or are otherwise known to correspond to efficient chiller operation. At step 30 a measure of efficiency or, equivalently in this context, a measure of inefficiency, is computed. The comparison can be made and efficiency or inefficiency can be computed in any suitable manner and will also depend upon the nature of the measured parameter. Some exemplary formulas that involve various chiller parameters and computational steps are set forth below. Nevertheless, the association between the measured parameter and the value(s) known to correspond to efficient operation can be expressed in the software not only by such formulas but, alternatively, as tables or any other well-known computational means and comparison means. Note that the measure of inefficiency that is displayed or otherwise output via the user interface can be expressed on a scale of 100% of full efficiency (e.g., "75%" of full efficiency), by the amount full efficiency is negatively affected or impacted (e.g., "25%" below full efficiency), or expressed in any other suitable manner. Although in the illustrated embodiment of the invention the efficiency computation occurs in response to a user selecting a chiller 10, in other embodiments the computation can occur at any other suitable time or point in the process in response to any suitable occurrence.

At step 32 the cost of the inefficiency is computed in terms of the cost of the energy that is used by operation below optimal or expected efficiency over a predetermined period of time, such as one year. The cost impact is output so that the user can see the cost savings that could be achieved over the course of, for example, one year, if the chiller problem causing the inefficiency were rectified.

At step 34 the parameter or parameters involved in the determination that the chiller is operating inefficiently are used to identify a chiller component. For example, as described below in further detail, the condenser is identified as the source of inefficiency if measured condenser pressure exceeds a predetermined value. At step 36 a problem associated with the identified component and identified parameter(s) is identified and, at step 38, a corresponding remedial action is output for the user. For example, if condenser pressure exceeds a predetermined value, the condenser may contain excessive amounts of non-condensable matter and should be purged of non-condensables or otherwise serviced. Thus, in this case the output that the user receives indicates the percentage efficiency at which the chiller is operating, indicates the amount of non-condensables, and advises the user to service the condenser.

Figure 3:
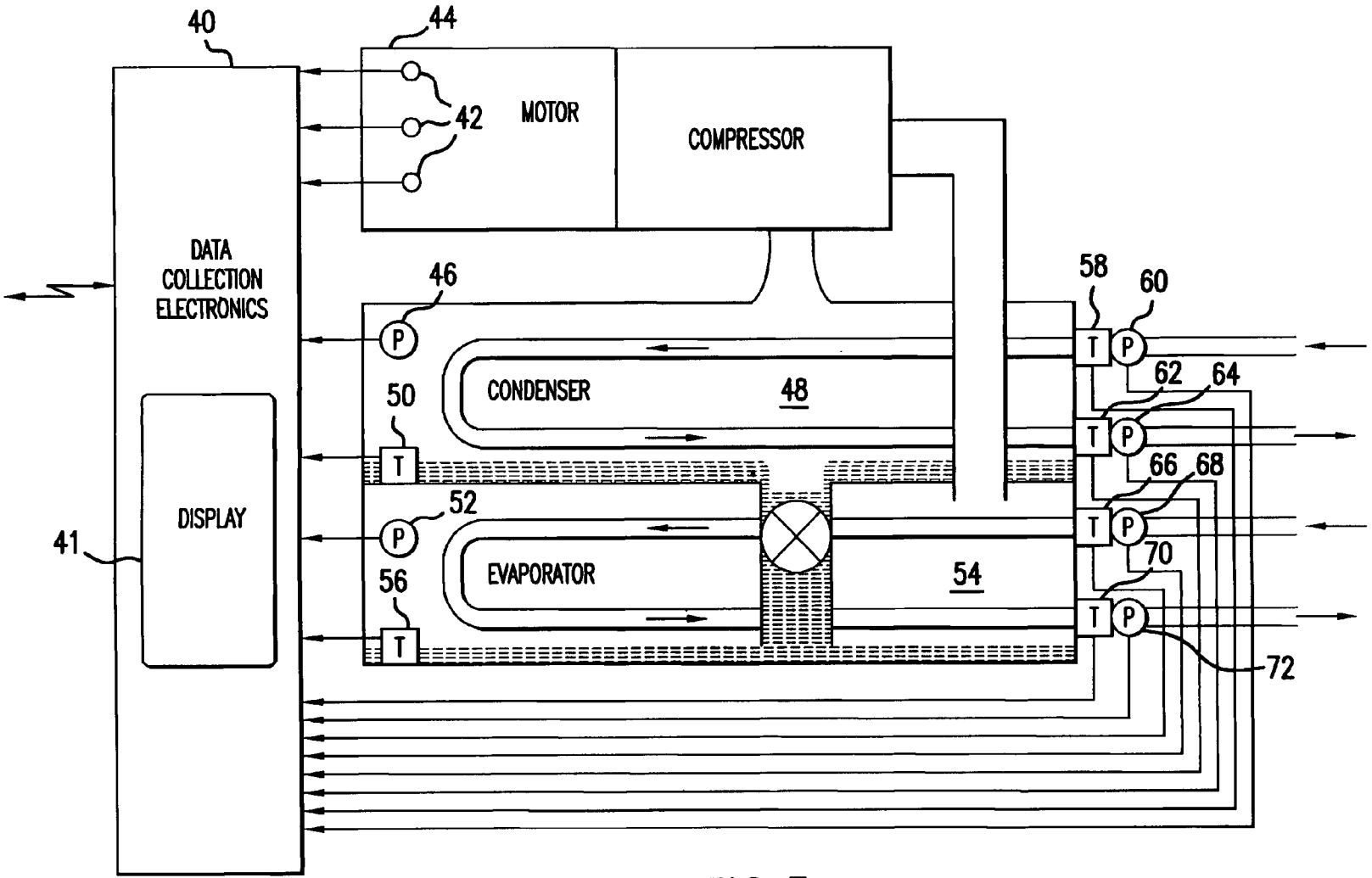
FIG. 3 is a block diagram illustrating a chiller and sensors configured to communicate data with a remote server computer.

FIG. 3 illustrates a chiller 10 and associated electronics 40 in an embodiment of the invention in which electronics 40 automatically takes readings from sensors 42-72 connected to chiller 10. Nevertheless, in other embodiments user-readable gauges or other instruments can be used instead of sensors 42-72. In the illustrated embodiment, a user can nonetheless also read the measurements taken by sensors 42-72 on a suitable instrument panel 41 (display) included in electronics 40.

The following sensors are included in the illustrated embodiment of the invention, but other suitable sensors can be used in addition or alternatively. Chiller 10 includes three electrical current sensors 42, each connected across a phase of the compressor motor 44 of chiller 10, that measure motor current (I). Nevertheless, in other embodiments of the invention, there may be fewer current sensors. Voltage sensors (not shown) can also be included. Chiller 10 also includes a pressure sensor 46 mounted in the condenser 48 of chiller 10 that measures condenser pressure ($P_{COND}$). Chiller 10 further includes a temperature sensor 50 immersed in the liquid refrigerant or suitably mounted on the surface of condenser 48 that measures condenser refrigerant temperature ($T_{COND_REFR}$). Similarly, chiller 10 includes a pressure sensor 52 mounted in the evaporator 54 of chiller 10 that measures evaporator pressure ($P_{EVAP}$) and a temperature sensor 56 immersed in the liquid refrigerant or suitably mounted on the surface of evaporator 54 that measures evaporator refrigerant temperature ($T_{EVAP_REFR}$). At the point where the water, brine or similar cooling liquid (which may be referred to in this patent specification as "water" for purposes of clarity) enters condenser 48 from the cooling tower (not shown), a temperature sensor 58 measures condenser input temperature ($T_{COND_IN}$) and a pressure sensor 60 measures condenser input pressure ($P_{COND_IN}$). Similarly, at the point where such water exits condenser 48 to the cooling tower (not shown), a temperature sensor 62 measures condenser output temperature ($T_{COND_OUT}$) and a pressure sensor 64 measures condenser output pressure ($P_{COND_OUT}$). At the point where the cooling water enters evaporator 54 after having circulated throughout building 12 (FIG. 1), a temperature sensor 66 measures evaporator input temperature ($T_{EVAP_IN}$) and a pressure sensor 68 measures evaporator input pressure ($P_{EVAP_IN}$). Similarly, at the point where the water exits evaporator 54 to circulate throughout building 12, a temperature sensor 70 measures evaporator output temperature ($T_{EVAP_OUT}$) and a pressure sensor 72 measures evaporator output pressure ($P_{EVAP_OUT}$). Each of sensors 42-72 provides its measurements to electronics 40, which in turn communicates the measurements to server 14. Electronics 40 can include a suitable computer, data-collection interfaces, and other elements with which persons of skill in the art will be familiar. Such persons will be readily capable of programming the computer to read sensors 42-72, communicate with server 14, perform the computations and evaluations described below, provide the user interface, and otherwise effect the steps described in this patent specification.

Although any chiller efficiency computation, formula or algorithm known in the art is contemplated within the realm of the invention, some specific computations are described in the form of the formulas set forth below.

Efficiency loss can occur if the condenser inlet temperature is too high. Specifically, it is believed that if the temperature is greater than approximately 85 degrees Fahrenheit (F), there is believed to be an efficiency loss of approximately two percent for each degree above 85. Server 14 receives the measured condenser input temperature ($T_{COND_IN}$) and computes:

$$\text{InletLoss}=(T_{COND_IN}-85)*2\% \quad (1)$$

If the loss is less than two percent, it is ignored. That is, server 14 does not report the efficiency and does not perform steps 34, 36 and 38 (FIG. 2) at which it would recommend a remedial action. If the loss is greater than two percent, server 14 outputs an indication of the amount and an indication that the cooling tower or cooling tower controls (i.e., elements of the cooling tower subsystem) should be serviced. Most chillers are designed to operate with 85 degrees (85°) or less entering cooling tower water temperature. If the entering condenser water temperature exceeds 85° the refrigerant condensing temperature and the condenser pressure increase accordingly. An increase in condenser pressure requires the compressor to expend power to do the same amount of cooling. The cause of the increased condenser water temperature should be identified and is generally attributed to a mechanical problem with the cooling tower or with the control system for maintaining cooling tower temperature.

As noted below, the user can request instructions for diagnosing and correcting the cooling tower subsystem problem. For example, the user can be instructed to check cooling tower instrumentation for accuracy and calibration and, if found to be faulty, instructed to recalibrate or replace the instruments. The user can also be instructed to review water treatment logs to insure proper operation, treatment and blowdown, and if irregularities are found, instructed to contact the water treatment company. The user can further be instructed to inspect condenser tubes for fouling, scale, dirt, etc., and if such is found, instructed to clean the tubes. The user can be also be instructed to check for division plate bypassing due to gasket problems or erosion and, if found to exist, instructed to replace the gasket.

Efficiency loss can also occur if the condenser approach is too high. Condenser approach is a term known in the art that refers to the difference between condenser refrigerant temperature ($T_{COND_REFR}$) and condenser outlet temperature ($T_{COND_OUT}$). Condenser approach can be adjusted for the load under which the chiller is operating to improve accuracy. Server 14 receives measurements for $T_{COND_REFR}$ and $T_{COND_OUT}$ as well as the compressor motor current (I) for each of the three motor phases. Server 14 takes the highest of the three current measurements (RunningCurrent) and divides by the full load current. Full load current is a fixed or constant parameter specified by the chiller manufacturer or obtained empirically, as well-understood in the art.

$$\%\ \text{Load}=(\text{RunningCurrent}/\text{FullLoadCurrent}) \quad (2)$$

The full load condenser approach then becomes:

$$\text{FullLoadCondenserApproach}=(T_{COND_REFR}-T_{COND_OUT})/\%\ \text{Load} \quad (3)$$

Among the constant or fixed parameters that the user is requested to input at the time of registering for the service is OptimalCondenserApproach. This parameter represents the condenser approach recommended by the chiller manufacturer or otherwise (e.g., by empirical measurement) determined to be optimal. Rather than input such a parameter, the user can opt at registration time to compute an EstimatedCondenserApproach based upon the age of the chiller. The user thus inputs the age of the chiller. For a chiller made during 1990 or later, EstimatedCondenserApproach is set to a value of one; for a chiller made during the 1980s, EstimatedCondenserApproach is set to a value of two, and for a chiller made before 1980, EstimatedCondenserApproach is set to a value of five.

If the user opted to input an OptimalCondenserApproach, and if FullLoadCondenserApproach is less than OptimalCondenserApproach, there is no efficiency loss. If FullLoadCondenserApproach exceeds OptimalCondenserApproach, then the ApproachDifference between them is computed:

$$\text{ApproachDifference}=\text{FullLoadCondenserApproach}-\text{OptimalCondenserApproach} \quad (4)$$

If the user opted to have an estimated condenser approach computed based upon the age of the chiller rather than to input a DesignCondenserApproach, and if FullLoadCondenserApproach is less than EstimatedCondenserApproach, there is likewise no efficiency loss. If FullLoadCondenserApproach exceeds EstimatedCondenserApproach, then the ApproachDifference between them is computed:

$$\text{ApproachDifference}=\text{FullLoadCondenserApproach}-\text{EstimatedCondenserApproach} \quad (5)$$

In either case, there is believed to be an efficiency loss of approximately two percent for every unit of ApproachDifference:

$$\text{CondenserApproachLoss}=\text{ApproachDifference}*2\% \quad (6)$$

If the loss is less than two percent, it is ignored. That is, server 14 does not output the efficiency to the user and does not perform steps 34, 36 and 38 (FIG. 2) at which it would recommend a remedial action. If the loss is greater than two percent, server 14 outputs an indication of the amount and an indication that the condenser should be serviced.

An increase in the condenser approach indicates that either the condenser tubes are dirty or fouled, inhibiting heat transfer from the refrigerant to the cooling tower water or that the water flow through the condenser tubes is bypassing the tubes. In either case, the condition results in an increase in refrigerant condensing temperature and pressure resulting in the compressor expending more power to do the same amount of cooling. Tube fouling can be caused by scale forming on the inside of the tube surface or deposits of mud, slime, etc. Chemical water treatment is commonly used to prevent scale formation in condenser tubes. Condenser water bypassing the tubes can be caused by a leaking division plate gasket or an improperly set division plate.

As noted below, the user can request instructions for diagnosing and correcting the problem. For example, the user can be instructed to check instrumentation for accuracy and calibration and, if found inaccurate or out of calibration, instructed to recalibrate or replace the instruments. The user can also be instructed to review water treatment logs to insure proper operation, treatment and blowdown and, if irregularities are found, instructed to contact the water treatment company. The user can further be instructed to inspect condenser tubes for fouling, scale, dirt, etc. and, if found, to clean the tubes. The user can also be instructed to check for division plate bypassing due to gasket problems or erosion and, if such is found, instructed to replace the gasket.

Efficiency loss can also occur if there are non-condensables in the condenser. The amount of non-condensables is believed to be proportional to the difference between the condenser pressure ($P_{COND}$) and an optimal or design condenser pressure (OptimalCondenserPressure). The optimal condenser pressure can be determined from a set of conversion tables that relate temperature to pressure for a variety of refrigerant types. Such tables are well-known in the art and are therefore not provided in this patent specification. At registration, the user is requested to input the refrigerant type used in each chiller 10. The relative amount of non-condensable matter is computed as follows:

$$\text{NonCondensables}=P_{COND}-\text{OptimalCondenserPressure} \quad (7)$$

If NonCondensables is less than or equal to zero, there is no efficiency loss. If it is positive, it is multiplied by a constant determined in response to refrigerant type and unit of pressure measurement. If the refrigerant is type R-11, R-113 or R-123, MultiplierConstant is set to five if the unit of measurement is PSIA or PSIG, and 2.475 if the unit of measurement is inches of mercury (InHg). If the refrigerant type is R-12, R-134a, R-22 or R-500, MultiplierConstant is set to one. These constants are believed to produce accurate results and are therefore provided as examples, but any other suitable constants can be used in the computations.

The loss attributable to the presence of non-condensables in the condenser is thus:

$$\text{NonCondLoss}=\text{NonCondensables}*\text{MultiplierConstant} \quad (8)$$

If the loss is less than two percent, it is ignored. Server 14 does not output the efficiency to the user and does not perform steps 34, 36 and 38 (FIG. 2) at which it would recommend a remedial action. If the loss is greater than two percent, server 14 outputs an indication of the amount and an indication that the condenser should be serviced.

Air or other non-condensable gases can enter a centrifugal chiller either during operation or due to improper servicing. Chillers operating with low pressure refrigerants can develop leaks that allow air to enter the chiller during operation. Air that leaks into a chiller accumulates in the condenser, raising the condenser pressure. The increase in condenser pressure results in the compressor expending more power to do the same amount of cooling. Chillers using low pressure refrigerants have a purge installed to remove non-condensables automatically. Air or other non-condensables can accumulate when the leak is greater than the purge can handle or if the purge is not operating properly.

As noted below, a user can request instructions for diagnosing and correcting the problem. For example, the user can be instructed to check instrumentation for accuracy and calibration and, if found inaccurate or out of calibration, instructed to recalibrate or replace the instruments. The user can also be instructed to check to insure liquid refrigerant is not building up in the condenser pressure gauge line and, if it is, instructed to blow down the line or apply heat to remove the liquid. A buildup of liquid in this line can increase the pressure gauge reading, giving a false indication of non-condensables in the chiller. The user can further be instructed to check the purge for proper operation and purge count and, if improper operation is found, instructed to turn the purge on or repair the purge. If purge frequency is excessive, the chiller should be leak-tested.

Efficiency loss can also occur if condenser water flow is too low. At registration, the user is requested to enter an optimal or design condenser water pressure drop (CondenserOptimalDeltaP) for the chiller. An actual condenser water pressure drop is computed:

$$\text{CondenserActualDelta}P=P_{COND_IN}-P_{COND_OUT} \quad (9)$$

If the unit of measurement is in feet (i.e., weight of water column) rather than PSIG, it is converted to PSIG by multiplying by 0.4335. Then, the delta variance is computed:

$$\text{DeltaVariance}=\text{square root of (CondenserActualDeltaP/CondenserOptimalDelta}P \quad (10)$$

A final variance is then computed by compensating for temperature. As flow is reduced through the condenser the quantity $T_{COND_OUT}-T_{COND_IN}$ increases proportionally. In other words, if the flow is reduced by, for example, 50%, this quantity increases by 50%. This results in the condenser refrigerant temperature increasing as well as the condenser pressure increasing, requiring the compressor to use more energy for the same load. If the chiller is operating under a light load, as indicated by a low $T_{COND_OUT}-T_{COND_IN}$ then the impact of low flow is small. If the chiller is operating under a heavy load as indicated by a high $T_{COND_OUT}-T_{COND_IN}$ then the impact on chiller efficiency is proportionally greater.

$$\text{FinalVariance}=(1-\text{DeltaVariance})*(T_{COND_OUT}-T_{COND_IN}) \quad (11)$$

If FinalVariance is less than or equal to zero, there is no efficiency loss. If FinalVariance is positive, there is believed to be an efficiency loss of approximately two percent for every unit of FinalVariance:

$$\text{FlowLoss}=\text{FinalVariance}*2\% \quad (12)$$

If the loss is less than two percent, it is ignored. Server 14 does not output the efficiency to the user and does not perform steps 34, 36 and 38 (FIG. 2) at which it would recommend a remedial action. If the loss is greater than two percent, server 14 outputs an indication of the amount and an indication that the condenser should be serviced.

As noted below, a user can request instructions for diagnosing and correcting the problem. Low condenser water flow may or may not be a true problem. Older chillers were typically designed for 3 gallons per minute (GPM) per ton of cooling. Some new chillers are designed with variable condenser flow to take advantage of pump energy savings with reduced flow. If the chiller at issue is designed for fixed condenser water flow, then a reduction in flow indicates a problem in the system. The user can be instructed to check the condenser water pump strainer and, if clogged, instructed to blow down or clean the strainer. The user can be instructed to check the cooling tower makeup valve for proper operation and proper water level in the tower sump and, if operating improperly, instructed to correct the valve. The user can also be instructed to check the condenser water system valves to ensure they are properly opened and, if they are not, to open or balance the valves. The user can be instructed to check pump operation for indications of impeller wear, RPM, etc. and, if a problem is found, to repair the pump or drive. The user can further be instructed to check the tower bypass valves and controls for proper operation and, if operating improperly, instructed to repair the valves or controls as necessary.

Server 14 also can compute and output an indication of the condenser water flow itself:

$$\text{Flow}=(1-\text{DeltaVariance})*100 \quad (13)$$

Efficiency loss can also occur if evaporator approach is too high. Evaporator approach is a term known in the art and refers to the difference between the evaporator refrigerant temperature (determined by taking the lowest of the two indicators: either measured refrigerant temperature or evaporator pressure converted to temperature from a conversion table) and the leaving chill water temperature ($T_{EVAP_OUT}$). This method is used because of the potential difficulty in some chillers to get an accuracy refrigerant temperature reading. An increase in evaporator approach is caused by either a loss of refrigerant charge in the chiller due to a leak, fouling on the evaporator tubes due to dirt or scale or chill water bypassing the tubes due to a leaking division plate gasket or improperly set division plate. This results in an decrease in evaporator refrigerant temperature for the same leaving chill water temperature. As a result, the evaporator pressure decreases and the compressor energy increases.

At registration, the user is requested to enter an optimal or design evaporator approach (OptimalEvaporatorApproach). To compute evaporator approach from measured parameters, the tables referred to above are used to determine the temperature that corresponds to the measured evaporator pressure ($P_{EVAP}$) for the type of refrigerant used in the chiller. This temperature found in the tables is compared to the measured evaporator refrigerant temperature ($T_{EVAP_REFR}$), and the lower of the two is used in the following equation (UseTemp):

$$\text{FullLoadEvaporatorApproach}=(T_{EVAP_OUT}-\text{UseTemp})*(\text{FullLoadCurrent}/\text{RunningCurrent}) \quad (14)$$

where FullLoadCurrent and RunningCurrent are as described above.

The computed FullLoadEvaporatorApproach is then compared to the OptimalEvaporatorApproach. If OptimalEvaporatorApproach is greater than FullLoadEvaporatorApproach, there is no efficiency loss. If FullLoadEvaporatorApproach is greater than or equal to OptimalEvaporatorApproach, there is believed to be an efficiency loss of approximately two percent for every unit by which they differ:

$$\text{EvaporatorApproachLoss}=2\%*(\text{FullLoadEvaporatorApproach}-\text{OptimalEvaporatorApproach}) \quad (15)$$

The user can opt at registration to use an estimated evaporator approach based upon the age of the chiller rather than one specified by the chiller manufacturer or other means. If the user does not enter an OptimalEvaporatorApproach, then an EstimatedEvaporatorApproach is set to a value of three if the chiller was made during 1990 or later, a value of four if the chiller was made during the 1980s, and a value of six if the chiller was made before 1980. These constant values are believed to produce accurate results and are therefore provided as examples, but any other suitable values can be used. EstimatedEvaporatorApproach is then compared to FullLoadEvaporatorApproach. If EstimatedEvaporatorApproach is greater than FullLoadEvaporatorApproach, there is no efficiency loss. If FullLoadEvaporatorApproach is greater than or equal to EstimatedEvaporatorApproach, there is believed to be an efficiency loss of approximately two percent for every unit by which they differ:

$$\text{EvaporatorApproachLoss}=2\%*(\text{FullLoadEvaporatorApproach}-\text{EstimatedEvaporatorApproach}) \quad (16)$$

In either case (i.e., Equations 15 or 16) if the loss is less than two percent, it is ignored. Server 14 does not output the efficiency to the user and does not perform steps 34, 36 and 38 (FIG. 2) at which it would recommend a remedial action. If the loss is greater than two percent, server 14 outputs an indication of the amount and an indication that the evaporator should be serviced.

As noted below, a user can request instructions for diagnosing and correcting the problem. For example, the user can be instructed to check instrumentation for accuracy and calibration and, if found inaccurate or out of calibration, instructed to recalibrate or replace the instruments. The user can also be instructed to review maintenance logs and determine if excess oil has been added and, if so, how much. If indications are that excess oil has been added, the user can be instructed to take a refrigerant sample and measure the percentage of oil in the charge. If the oil content is greater than approximately 1.5-2%, the user can be instructed to reclaim the refrigerant or install an oil recovery system. If these measures do not correct the problem, then the problem may be due to the system being low on refrigerant charge or tube fouling. Some considerations in determining the course of action to take are whether the chiller had a history of leaks, whether the purge indicates excessive run time, whether the chiller is used in an open evaporator system such as a textile plant using an air washer, and whether there has been a history of evaporator tube fouling. If the answers to these questions do not lead to a diagnosis, the user can be instructed to trim the charge using a new drum of refrigerant. If the approach starts to come together as refrigerant is added, the user can continue to add charge until the approach temperature is within that specified by the manufacturer or otherwise believed to be optimal. This indicates a loss of charge and a full leak test is warranted. If adding refrigerant does not improve the evaporator approach, as a next step the user can be instructed to drop the evaporator heads and inspect the tubes for fouling, as well as inspecting the division plate gasket for a possible bypass problem, clean the evaporator tubes if necessary, and replacing division plate gasket if necessary.

A TotalEfficiencyLoss can be computed by summing the above-described InletLoss, CondenserApproachLoss, NoncondensablesLoss, FlowLoss, SetpointLoss, and EvaporatorApproachLoss.

A TargetCostOfOperation can be computed as the arithmetic product of the number of weeks per year the chiller is operated, the number of hours per week the chiller is operated, the average load percentage on the chiller, the efficiency rating of the chiller (as specified by the chiller manufacturer), the cost of a unit of energy and the tonnage of the chiller. The ActualCostOfOperation can then be computed by applying the TotalEfficiencyLoss:

$$\text{ActualCostOfOperation}=(1+(\text{TotalEfficiencyLoss}))*\text{TargetCostOfOperation} \quad (17)$$

The cost of energy due to the total efficiency loss is:

$$\text{TotalCostOfEnergyLoss}=\text{ActualCostOfOperation}-\text{TargetCostOfOperation} \quad (18)$$

Note that the cost of energy due to efficiency loss in each of the six categories described above is computed by multiplying the loss percentage for a category (e.g., FlowLossPercentage) by the TargetCostOfOperation.

Screen displays of exemplary graphical user interfaces through which a user can interact with the system are illustrated in FIGS. 4-17-1. Such a user interface can follow the well-known hypertext protocol of the World Wide Web, with server computer 14 providing web pages to client computer 16 or, in some embodiments, to handheld data device 18. (See FIG. 1.)

Figure 4:
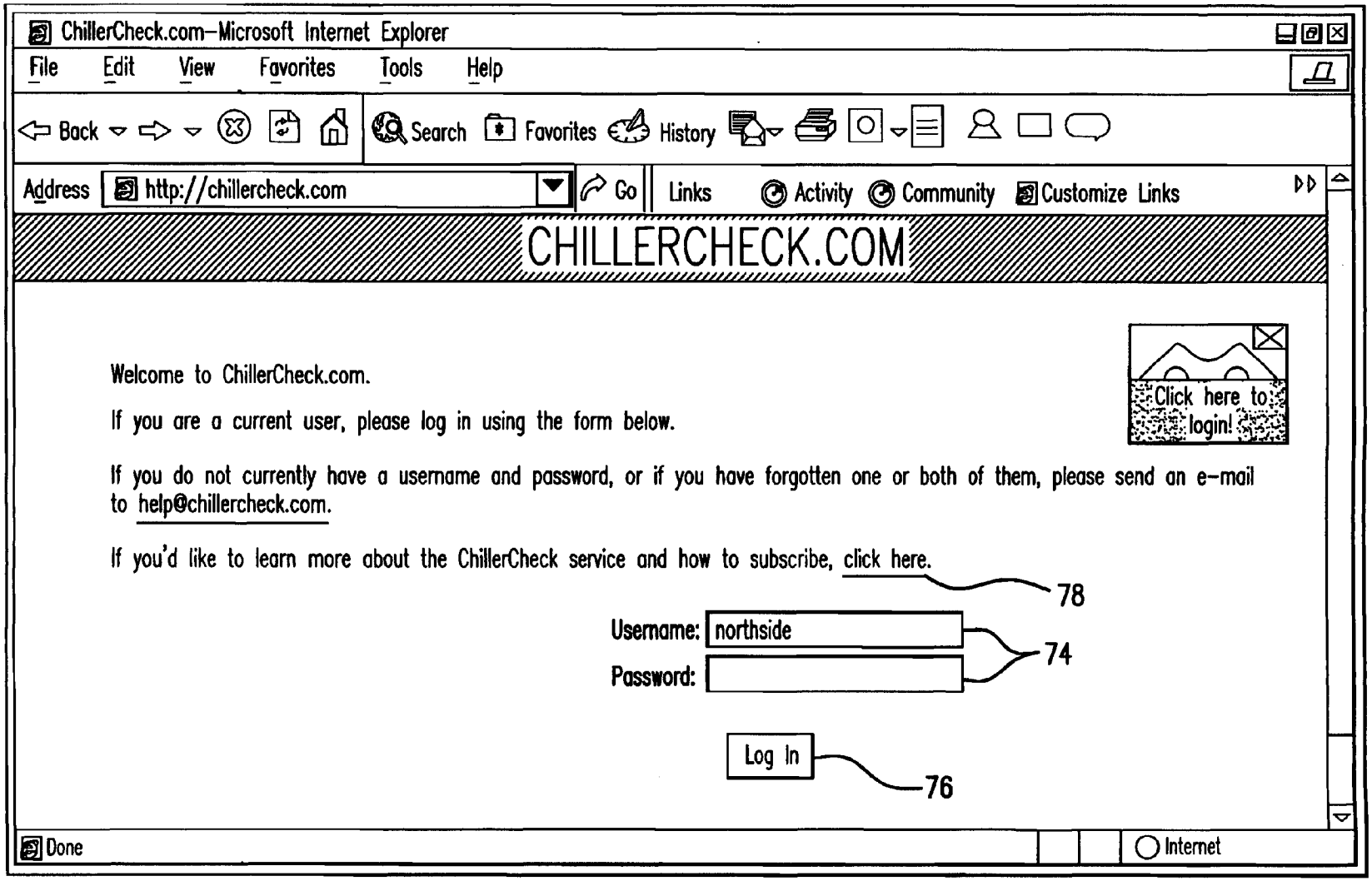
FIG. 4 depicts a login screen of an exemplary graphical user interface (GUI)

As illustrated in FIG. 4, an initial web page presented to client computer 16 includes text entry boxes 74 into which a user can enter a username and password. Upon activating a "log in" button 76, client computer 16 returns the entered information to server computer 14, which compares the information to a list of usernames and passwords of authorized users. If the username and password matches that of an authorized user, i.e., a subscriber to the chiller evaluation service, server computer 14 transmits the web page shown in FIG. 5 to client computer 16. If a person is not yet a subscriber, the person can activate or "click on" a hyperlink 78. In response, server computer 14 provides a sequence of one or more web pages (not shown) through which one can sign up or subscribe to the service. To subscribe, a person provides information about chillers 10 the person is charged with maintaining, information identifying himself (or the owner or operator of chillers 10), payment or credit information, and any other pertinent information. Other avenues for subscribing, such as over the telephone, can also be provided.

Figure 5:
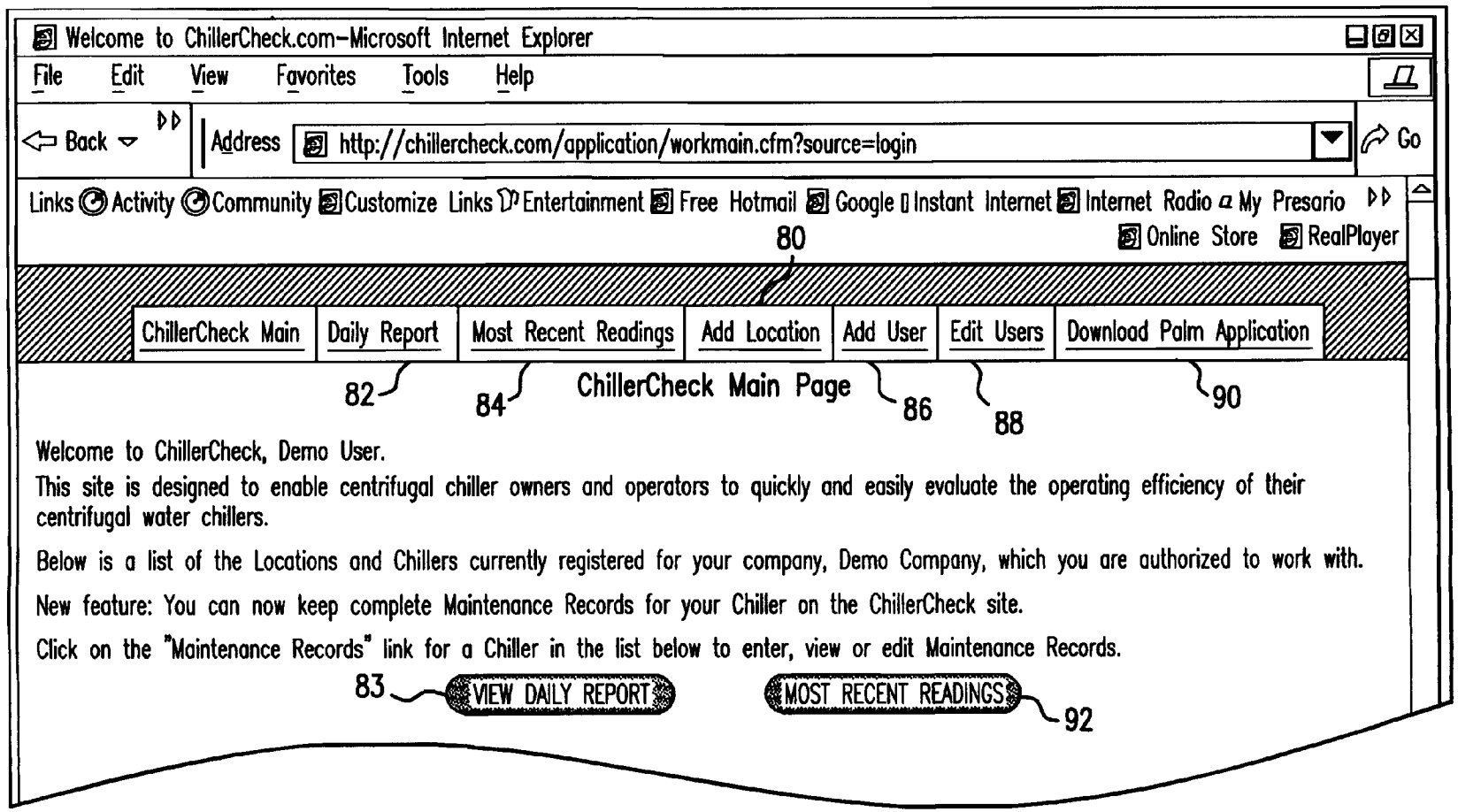
FIG. 5 depicts a main screen of the GUI.
Figures 1, 5:
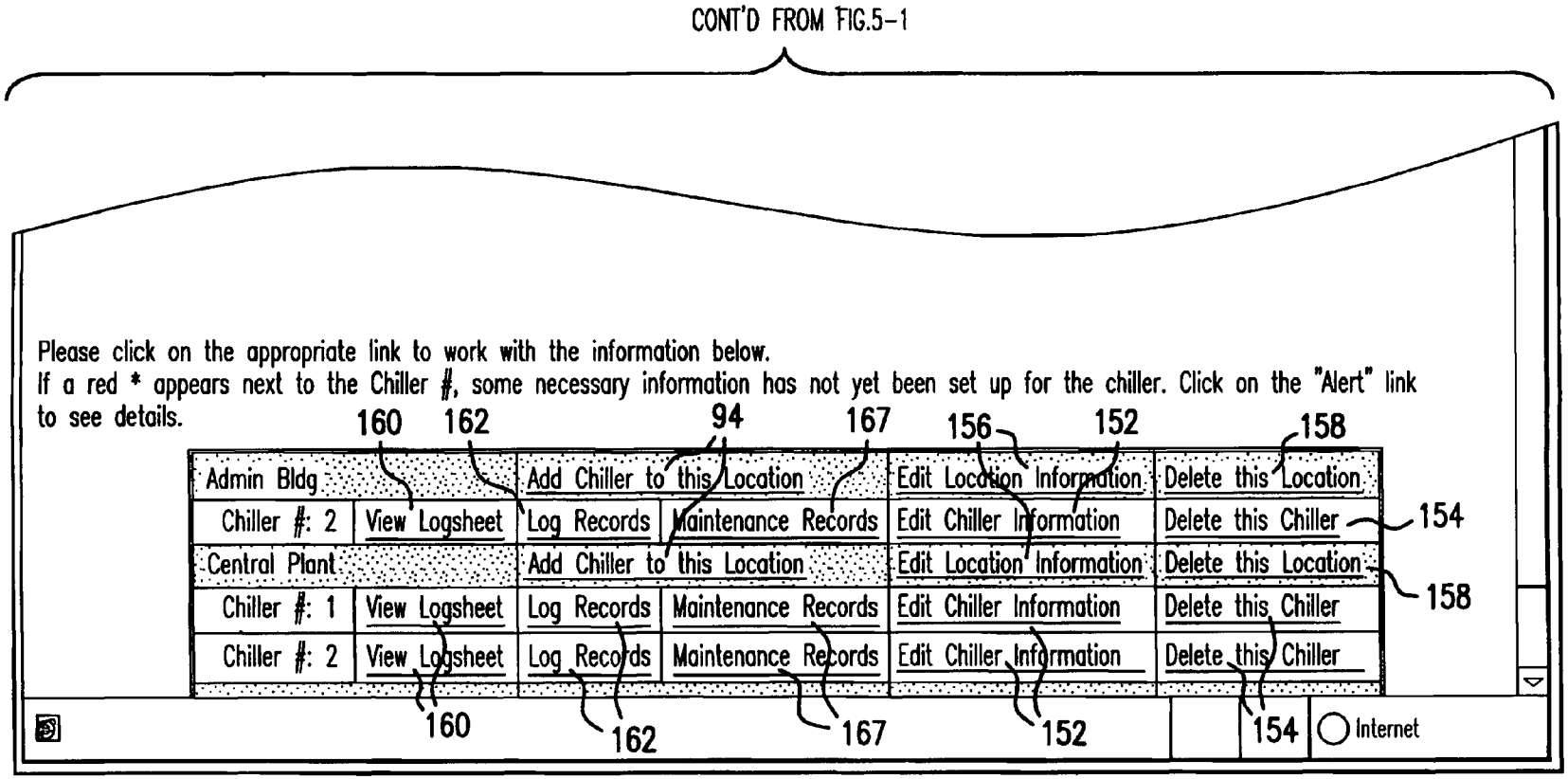
Figure 6C:
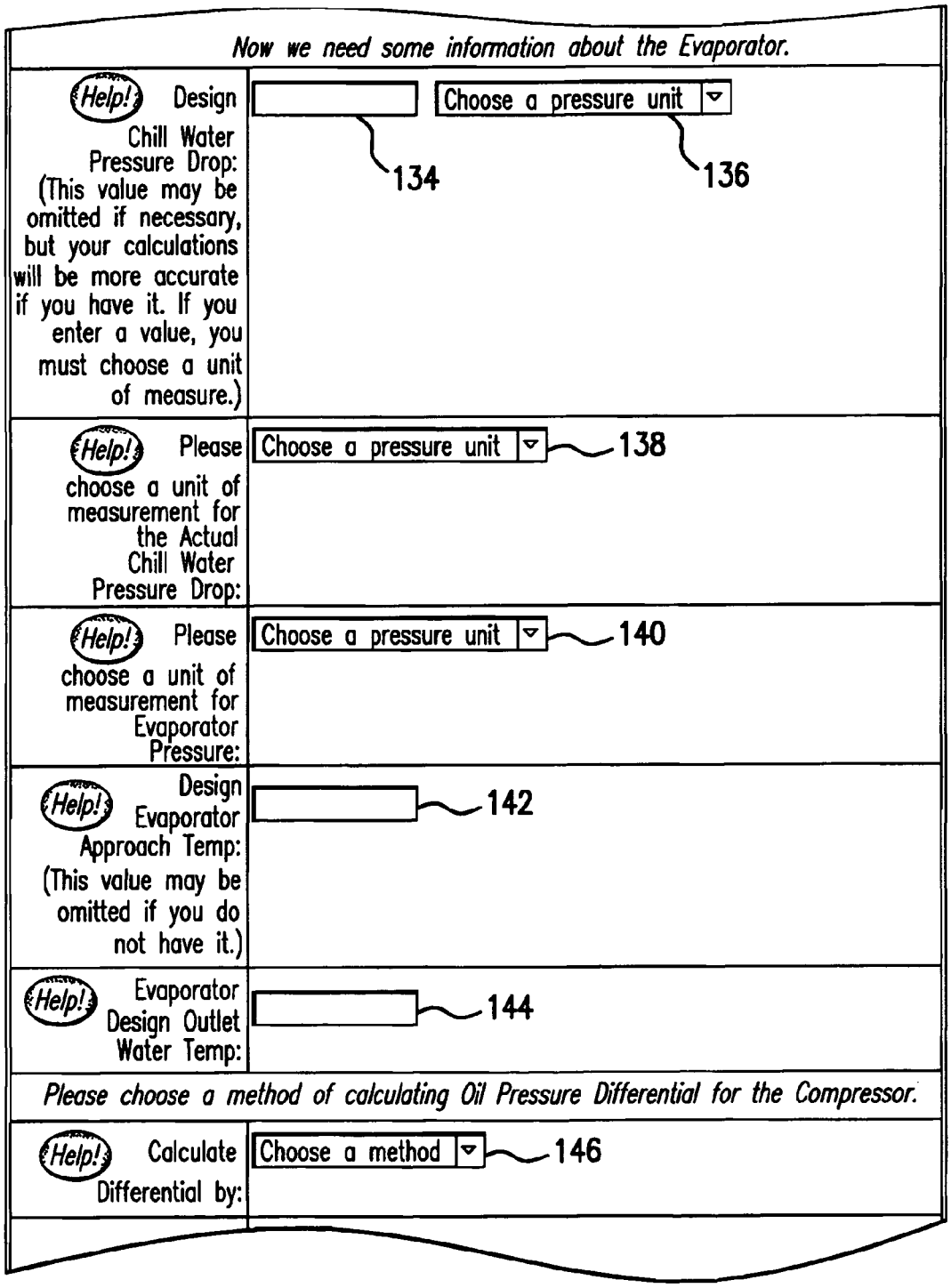
FIG. 6C is a continuation of FIG. 6B.
Figure 6D:
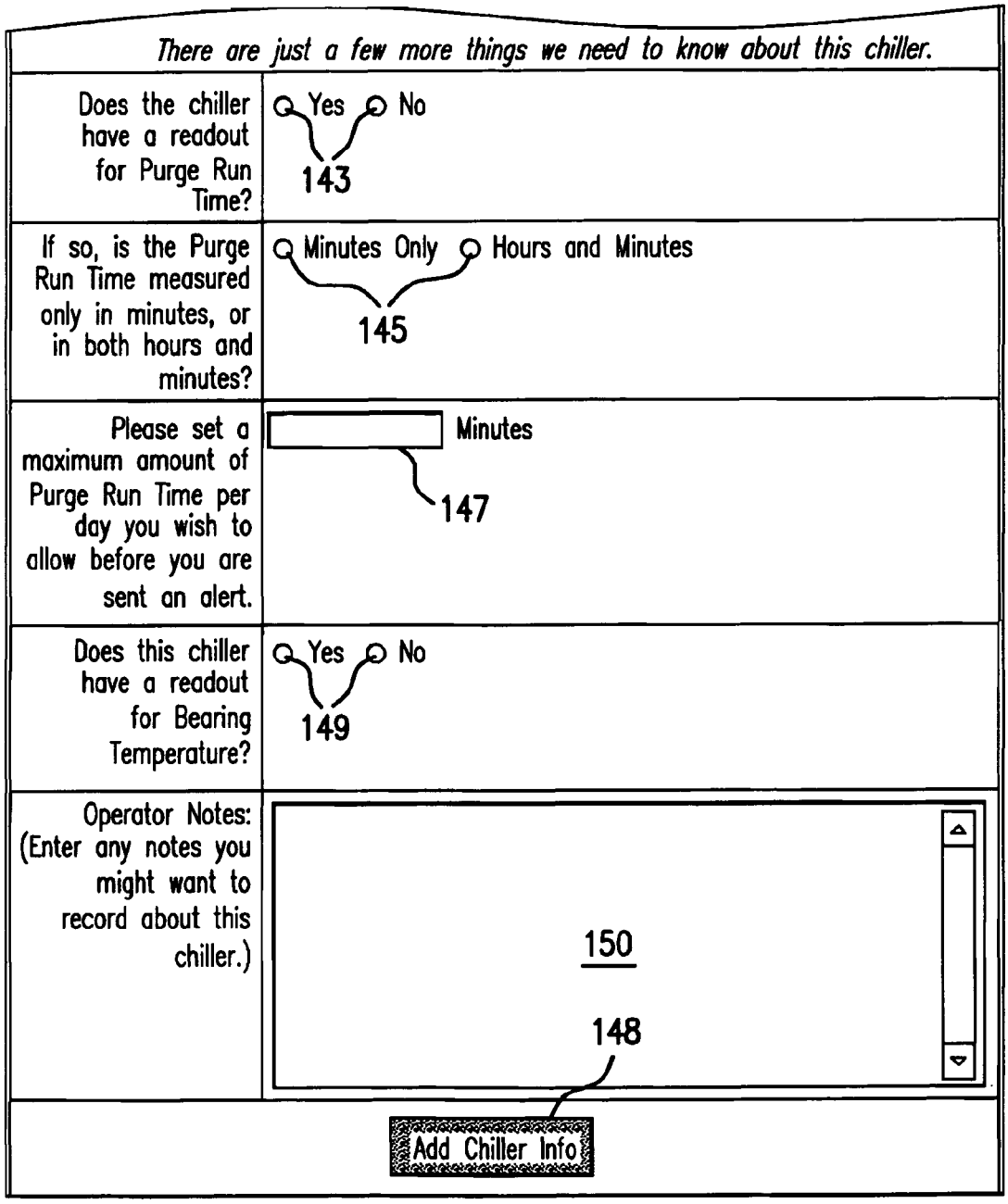
FIG. 6D is a continuation of FIG. 6C.

As illustrated in FIG. 5, a main web page presents the user with various options and lists all chillers 10 that the user has previously identified. In the illustrated example, locations or sites identified as "Admin Bldg." and "Central Plant" are visible in the displayed portion of the web page, along with one chiller at the "Admin Bldg." site, identified as "Chiller #2 ," and two chillers at the "Central Plant" site, identified as "Chiller #1," "Chiller #2 ." If the user had not used the service before, no locations or chillers would be listed. Note the "Add Location" hyperlink 80 at the top of the page. In response to activating hyperlink 80, the user is presented with a page (not shown) through which the user can identify a new site having chillers the user wishes to monitor and evaluate. Other options are represented by a "Daily Report" hyperlink 82 (and an equivalent "View Daily Report" button 83), a "Most Recent Readings" hyperlink 84, an "Add User" hyperlink 86, an "Edit Users" hyperlink 88 and a "Download PALMS® Application" hyperlink 90. Another option is represented by a "Most Recent Readings" button 92, and still other options relate to the chillers listed at the bottom of the web page. As described below, a user can select any one of the listed chillers and view information relating to it, cause efficiency computations to be performed for it, and perform other tasks relating to it.

"Add a Chiller to this Location"0 hyperlinks 94 relate to each of the listed chiller locations ("Admin Bldg." and "Central Plant" in the example illustrated by the web page of FIG. 5.) In response to activating one of hyperliniks 94, the user is presented with a page such as that shown in FIGS. 6A-6D. The page allows the user to identify a chiller for monitoring and evaluation and enter various fixed or constant parameters. For example, the page includes: a "Chiller #" text entry box 96 for entering a chiller number (as multiple chillers at the same site are typically identified by a number, e.g., "Chiller #1"); a "Make" selection box 98 for selecting the name of the manufacturer of the chiller; a "Model" text entry box 100 for entering the model number or name of the chiller; a "Serial #" text entry box 102 for entering the serial number of the chiller; a "Refrigerant Type" selection box 104 for selecting the type of refrigerant used in the chiller; a "Year Chiller was Manufactured" selection box 106 for entering the year in which the chiller was manufactured; an "Efficiency Rating" text entry box 108 for entering the efficiency rating specified by the manufacturer or other source (typically specified in units such as kilowatts per ton); an "Energy Cost" text entry box 110 for entering the cost of one unit energy (e.g., one kilowatt-hour of electricity); a "Weekly Hrs. of Operation" text entry box 112 for entering the hours per week the chiller is typically operated; a "Weeks Per Year of Operation" text entry box 114 for entering the weeks per year the chiller is typically operated; an "Average Load Profile" text entry box 116 for entering the load percentage under which the chiller typically operates; a "Tons" text entry box 118 for entering the chiller tonnage; a "Design Voltage" text entry box 120 for entering the voltage at which the chiller compressor motor is specified by the manufacture to operate; a "Full Load Amperage" text entry box 122 for entering the current that the chiller compressor motor is specified by the manufacturer to draw under full load; a "Design Condenser Water Pressure Drop" text entry box 124 for entering the value specified by the manufacturer or otherwise determined to be optimal; a condenser pressure drop units selection box 126 for selecting the units in which the design or optimal pressure drop is specified; an "Actual Condenser Water Pressure Drop" units selection box 128 for selecting the units in which the measured pressure drop is measured; a condenser pressure units selection box 130 for selecting the units in which condenser pressure is measured; a "Design Condenser Approach Temperature" text entry box 132 for entering the condenser approach temperature specified by the manufacturer or otherwise determined to be optimal; a "Design Chill Water Pressure Drop" text entry box 134 for entering the value specified by the manufacturer or otherwise determined to be optimal for chill water pressure drop through the evaporator; a chill water pressure drop units selection box 136 for selecting the units in which the design or optimal pressure drop is specified; an "Actual Chill Water Pressure Drop" units selection box 138 for selecting the units in which the measured pressure drop is measured; an evaporator pressure units selection box 140 for selecting the units in which evaporator pressure is measured; a "Design Evaporator Approach Temperature" text entry box 142 for entering the evaporator approach temperature specified by the manufacturer or otherwise determined to be optimal; a "Design Outlet Water Temperature" text entry box for entering the water temperature at the evaporator outlet specified by the manufacturer or otherwise determined to be optimal; and a method selection box 146 for selecting the method from among alternatives methods by which oil pressure differential for the compressor can be computed. (Oil pressure differential can be computed and displayed or otherwise output for the convenience of the user but is not used as an input to the efficiency computations to which the invention relates.)

The page further includes: purge run time readout "yes" and "no" checkboxes 143 for indicating whether the chiller has a readout for purge run time; "minutes only" and "hours and minutes" checkboxes 145 for indicating units in which purge run time is measured; a "minutes" text entry box 147 for entering the maximum daily purge run time to allow before alerting the user; and bearing temperature readout "yes" and "no" checkboxes 149 for indicating whether the chiller has a readout for compressor bearing temperature. A text entry box 150 is also provided for the user to enter notes about the chiller.

When the user has entered all of the above-listed fixed or constant chiller parameters, the user activates the "Add Chiller Info" hyperlink 148. In response, client computer 16 transmits the information the user entered on this page back to server computer 14 (FIG. 1). Server computer 14 stores the information in a database for use in the computations described above.

The user would be presented with a web page (not shown) similar to that of FIGS. 6A-6D in response to activating one of the "Edit Information for this Chiller" hyperliniks 152 on the web page of FIG. 5. Through that web page, a user could change information previously entered for a listed chiller. Similarly, activating one of the "Delete this Location" hyperliniks 154 causes the chiller and its corresponding information to be deleted from the listing and the database. Note that by activating one of the "Edit Information for this Location" hyperliniks 156 a user can change the name of the location ("Admin Bldg" or "Central Plant" in the illustrated example) or other information about the site or location at which the listed chillers are installed. By activating one of the "Delete this Location" hyperlinks 158 all chillers and their corresponding information listed under that location are deleted from this listing and the database.

With regard to some of the other options indicated on the web page of FIG. 5, note that hyperlinks 86 and 88 relate to authorizing additional users, such as co-workers, to use the system, and hyperlink 90 relates to downloading software to handheld data device 18 (FIG. 1). Although in some embodiments of the invention handheld data device 18 can be used in essentially the same manner as client computer 16, acting as a client to server computer 14 through a web browser program, in other embodiments of the invention device 18 can operate independently of server computer 14 or less dependent upon server 14 than if it its only function were to execute a browser program (i.e., function as a so-called "thin client" to server computer 14). In other words, software can be loaded into device 18 that allows it to perform computations and other functions that are the same or a subset of those performed by server 14. Such software can be loaded into device 18 from any suitable source but can be conveniently downloaded from server computer 14 while the user is logged into the service.

Figure 7:
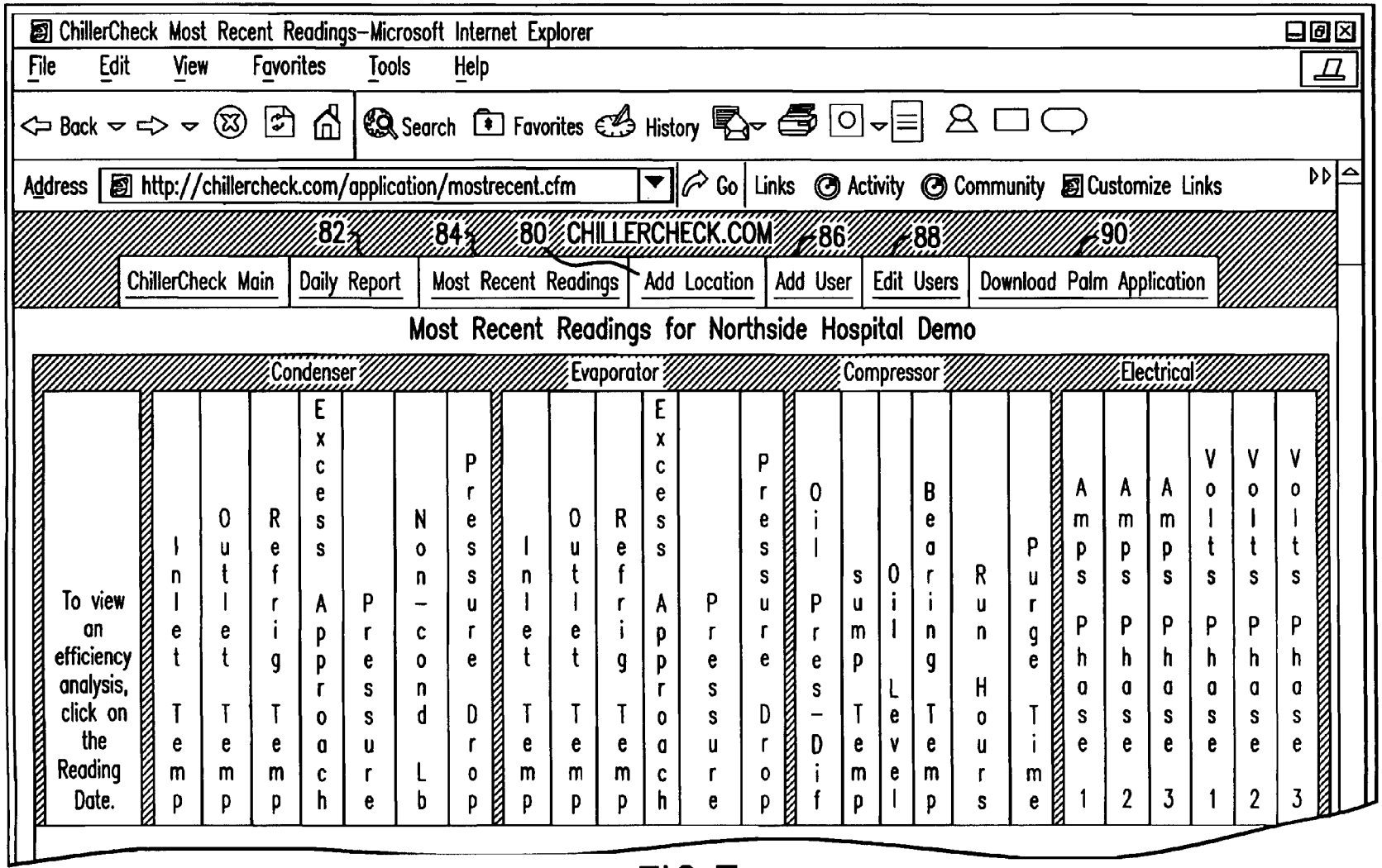
FIG. 7 depicts a screen showing most recent chiller readings.

In response to the user activating "Most Recent Readings" hyperlink 92 on the web page of FIG. 5, server computer 14 transmits to client computer 16 a web page such as that shown in FIG. 7. This page comprises a table listing each chiller in a row of the table and each of the most recently input parameter measurements for that chiller, as well as some of the intermediate results that can be computed as described above, in the columns of the table. As described above, measurements can be input manually by the user after having read them from gauges or other instruments or, in other embodiments of the invention, can be input automatically by having electronics 40 (FIG. 3) electronically read them from sensors 42-72 associated with the chiller and transmit them to server 14. Each set of parameters that is input for a chiller is known as a "log record" or "log sheet."

The web page of FIG. 5 illustrates the most recent log record for each chiller the user has identified to the system. The parameter measurements and computed values include those described above with regard to the efficiency computations that are performed as well as some that can be input for the sake of maintaining records but that are not used in the efficiency computations. As indicated in the columns (listed left to right) in the web page of FIG. 7, they are: condenser inlet temperature, condenser outlet temperature, condenser refrigerant temperature, condenser excess approach, condenser pressure, the amount of non-condensables, condenser pressure drop, evaporator inlet temperature, evaporator outlet temperature, evaporator refrigerant temperature, evaporator excess approach, evaporator pressure, evaporator pressure drop, compressor oil pressure, compressor sump temperature, compressor oil level, compressor bearing temperature, compressor run hours, compressor purge time, compressor motor current for each of the three phases and compressor motor voltage for each of the three phases. Note that not all of these parameters need be input; in some embodiments of the invention certain parameters may not be measurable or otherwise available. For example, the compressor oil pressure, sump temperature, and so forth, are not parameters that are used in the efficiency computations described above and are gathered only for the sake of maintaining records.

Figure 8:
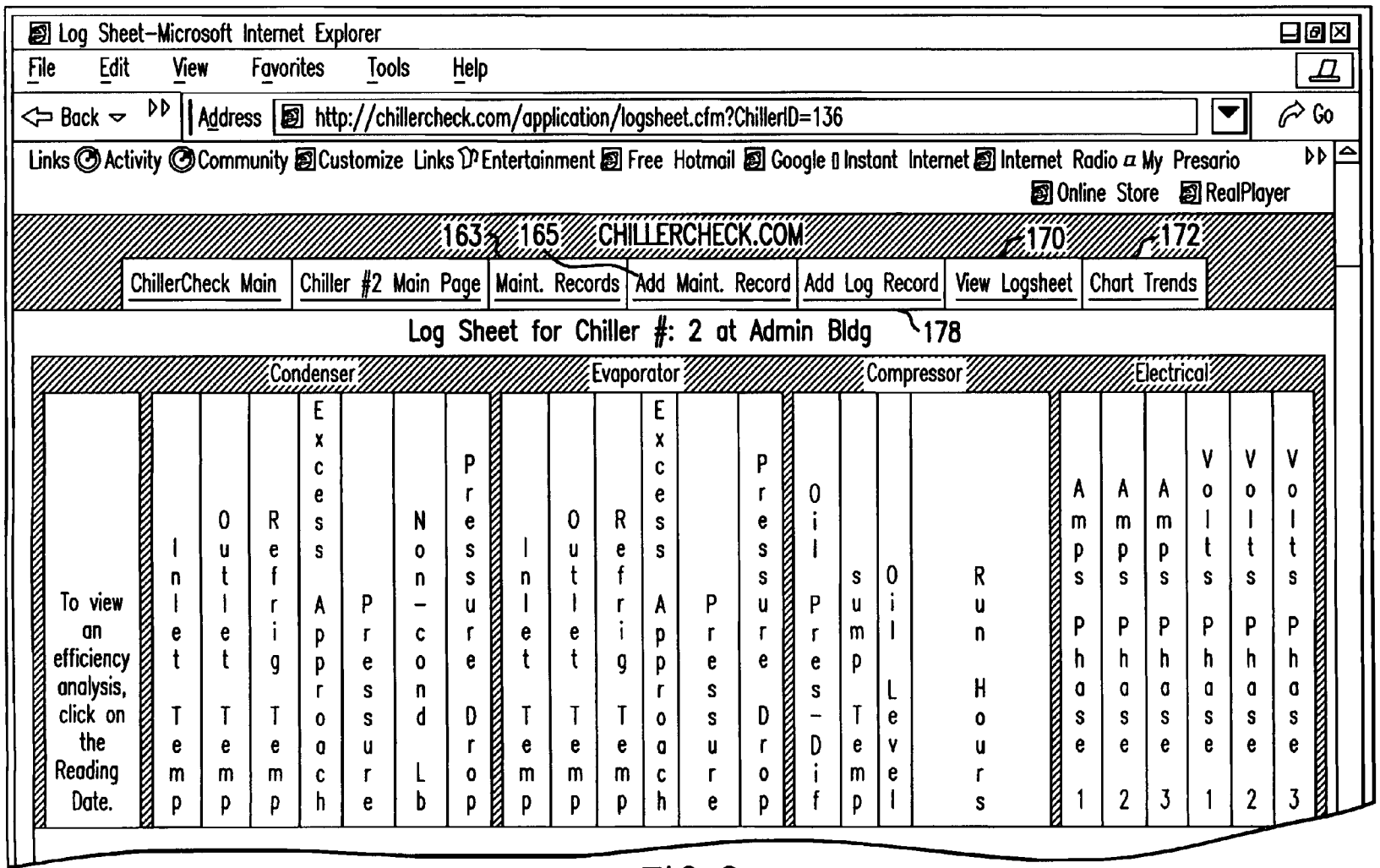
FIG. 8 depicts a screen showing a selected log record for a selected chiller.

In response to the user activating one of the "View Logsheet" hyperlinks 160 on the web page of FIG. 5, server computer 14 transmits to client computer 16 a web page such as that shown in FIG. 8. This web page is similar to that described above with regard to FIG. 7 in that it comprises a table listing each of the parameter measurements input for a chiller and related data. The columns of the table are labeled with these parameters as in FIG. 7. The rows of the table all relate to the chiller corresponding to the one of hyperlinks 160 the user activated. Each row relates to measurements taken or input for that chiller at a different time. Thus, the user can refer to this web page to assess how the parameter measurements for a selected chiller have changed over time. In the illustrated example, the time and date in the top row indicates the most recent measurement was taken at 9:08 a.m. on Aug. 24, 2001; the time and date in the next lower row indicates the next most recent measurement was taken at 12:00 p.m. on Aug. 21, 2001; and the time and date in the row beneath that indicates the next oldest measurement was taken at 4:00 p.m. on Aug. 17, 2001. The user can scroll further down the web page (not shown in FIG. 8) to view older measurements that may have been taken. As noted above, that the times and dates at which measurements are taken or input may depend upon the nature of the embodiment of the invention. For example, if measurements are input manually by a user, the user can read them and input them into the system whenever desired. The user may do so on a periodic basis, such as once per day or twice per day, or on a more random basis. In embodiments of the invention in which measurements are input automatically by electronically reading sensors under the control of software, such readings can be input at predetermined, controlled periods, such as every day at the same time of day.

Chiller maintenance records can be maintained for the convenience of the user, though they are not used in connection with any of the efficiency computations described above. In response to activating a "Maint. Records" hyperlink 163 on the web page of FIG. 8, server computer 16 transmits to client computer 14 a web page such as that shown in FIG. 17. This web page lists the types of maintenance that can be performed on the chiller and the most recent dates on which such maintenance was performed. In response to activating an "Add Maint. Record" hyperlink 165, server computer 16 transmits to client computer 14 a web page such as that shown in FIGS. 16A-16B that allows the user to add a new maintenance record for the chiller. This web page also lists the types of maintenance that can be performed on the chiller and includes selection boxes for the user to enter the date on which each was most recently performed.

To review log records, compute efficiencies, and perform other tasks, a user can activate one of the "Work with Log Records" hyperlinks 162 on the web page of FIG. 5. Each of hyperlinks 162 relates to one of the chillers. In response, server computer 16 transmits to client computer 14 a web page such as that shown in FIG. 9. This web page lists the log records for the selected chiller that have been input and stored in the database. The web page indicates the date and times at which each log record was created, i.e., the date and time the measurements were input. For any selected log record, the user can cause the system to compute the efficiency of the chiller at a date and time by clicking on a corresponding one of the "Calculate Efficiencies" hyperlinks 164. In response, server computer 16 performs the efficiency computation described above for the selected chiller using the parameter measurement data that was input at the date and time of the selected log record.

Other hyperlinks 166 and 168 allow the user to respectively edit or delete an individual log record. A "View Logsheet" hyperlink 170 causes server computer 14 to transmit the same type of web page described above with regard to FIG. 8. A "Chart Trends" hyperlink 172 causes server computer to create and transmit a chart web page or, alternatively, a window, such as that shown in FIG. 10. The chart includes a selection box 174 via which a user can select a parameter or computed value to chart (e.g., efficiency loss, condenser inlet temperature, condenser approach, non-condensables, evaporator approach, evaporator outlet temperature, condenser flow, evaporator flow, etc.) and another selection box 176 via which the user can select a time period (e.g., one month, three months, six months, one year, three years, etc.) over which to chart it. The chart shows how the selected parameter or computed result changed over the selected time period.

To review maintenance records for a chiller, a user can activate one of the "Maintenance Record" hyperlinks 167 on the web page of FIG. 5. Each of hyperlinks 167 relates to one of the chillers in the same manner as the above-described hyperlink 165. Thus, in response, server computer 16 transmits to client computer 14 the web page shown in FIG. 17. As noted above, this web page lists the types of maintenance that can be performed on the chiller and the most recent dates on which such maintenance was performed.

In an embodiment of the invention in which the chiller operating parameters are manually input by a user, the user can do so by activating the "Add New Log Record" hyperlink 178. Note that this can be done from any of the web pages that relate to individual chillers (i.e., the web pages of FIGS. 8, 9 and 10). In response, server computer 14 transmits a web page such as that illustrated in FIGS. 11A-11B. The page includes: "Reading Date" and "Reading Time" text entry boxes 180 and 182, respectively, for entering the date and time at which the measurements were taken; a condenser "Inlet Water Temperature" text entry box 184; a condenser "Outlet Water Temperature" text entry box 186; a condenser "Refrigerant Temperature" text entry box 188, a "Condenser Pressure" text entry box 190; an "Actual Condenser Water Pressure Drop" text entry box 192; an evaporator "Inlet Water Temperature" text entry box 194; an evaporator "Outlet Water Temperature" text entry box 196; an evaporator "Refrigerant Temperature" text entry box 198; an "Evaporator Pressure" text entry ox 200; an "Actual Chill Water Pressure Drop" text entry box 202; a compressor "Oil Pressure (High)" text entry box 204; a compressor "Oil Sump Temperature" text entry box 206; a compressor Oil Level" text entry box 208; a compressor "Bearing Temperature" text entry box 210; a compressor "Run Hours" text entry box 212; a compressor "Purge Pumpout Time" text entry box 214; compressor motor current text entry boxes 216, 218 and 220 for each the three phases, respectively; and compressor motor voltage text entry boxes 222, 224 and 226 for the three phases, respectively. A text entry box 228 is provided for the user to enter any notes about the chiller measurements. When the user has entered all of the above-listed chiller parameter measurements that are available, the user activates the "Add Log Record" hyperlinik 230. In response, client computer 16 transmits the information the user entered on this page back to server computer 14 (FIG. 1). Server computer 14 stores the information in a database for use in the efficiency computations described above. As noted above, not all of these parameters are used in the computations. Those that are not used in computations can be input, if available, for recordkeeping or logging purposes in a manner analogous to that in which they might have been written in a conventional log book prior to the present invention.

Figure 9:
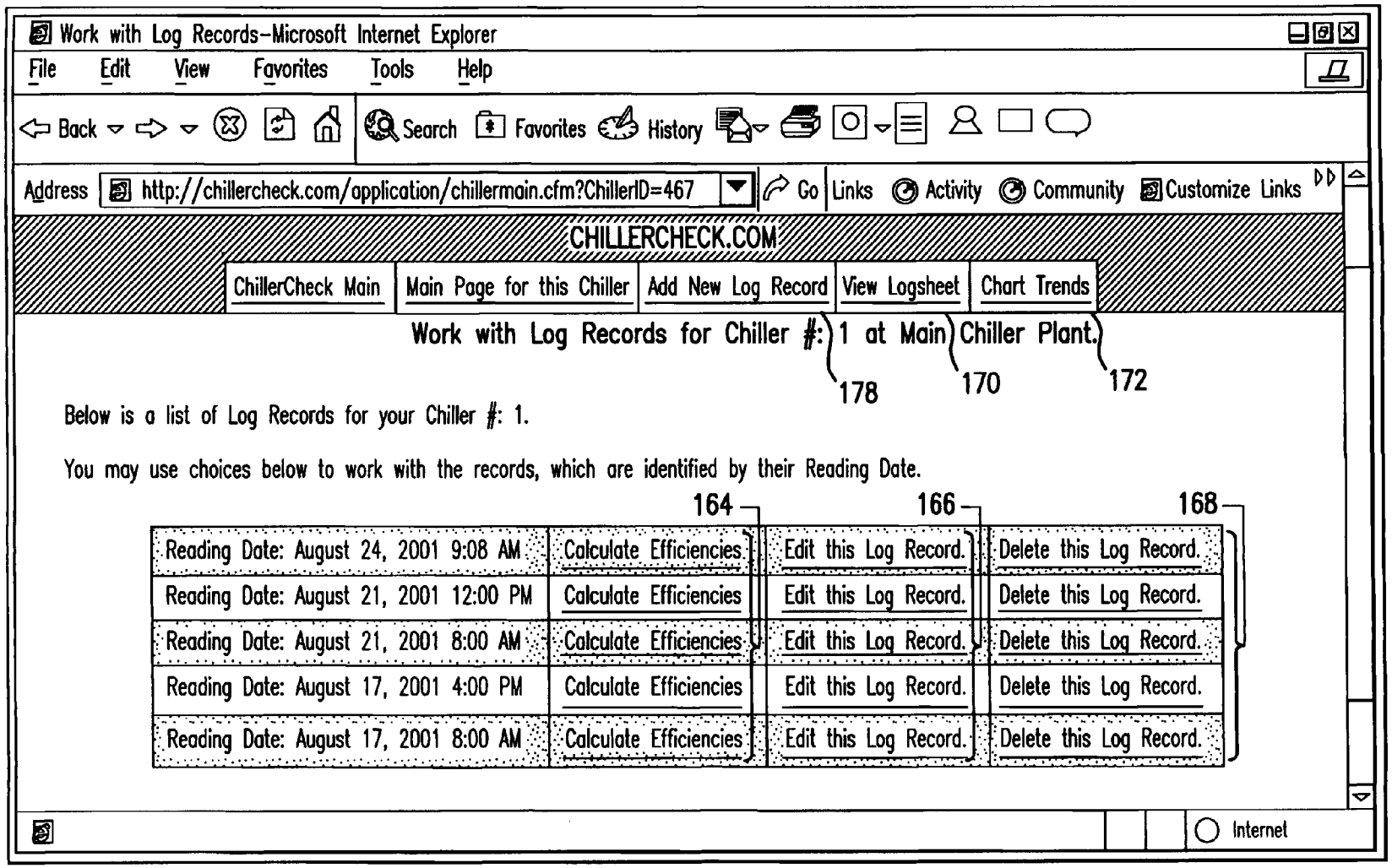
FIG. 9 depicts a screen showing log records from which a user can select.
Figure 10:
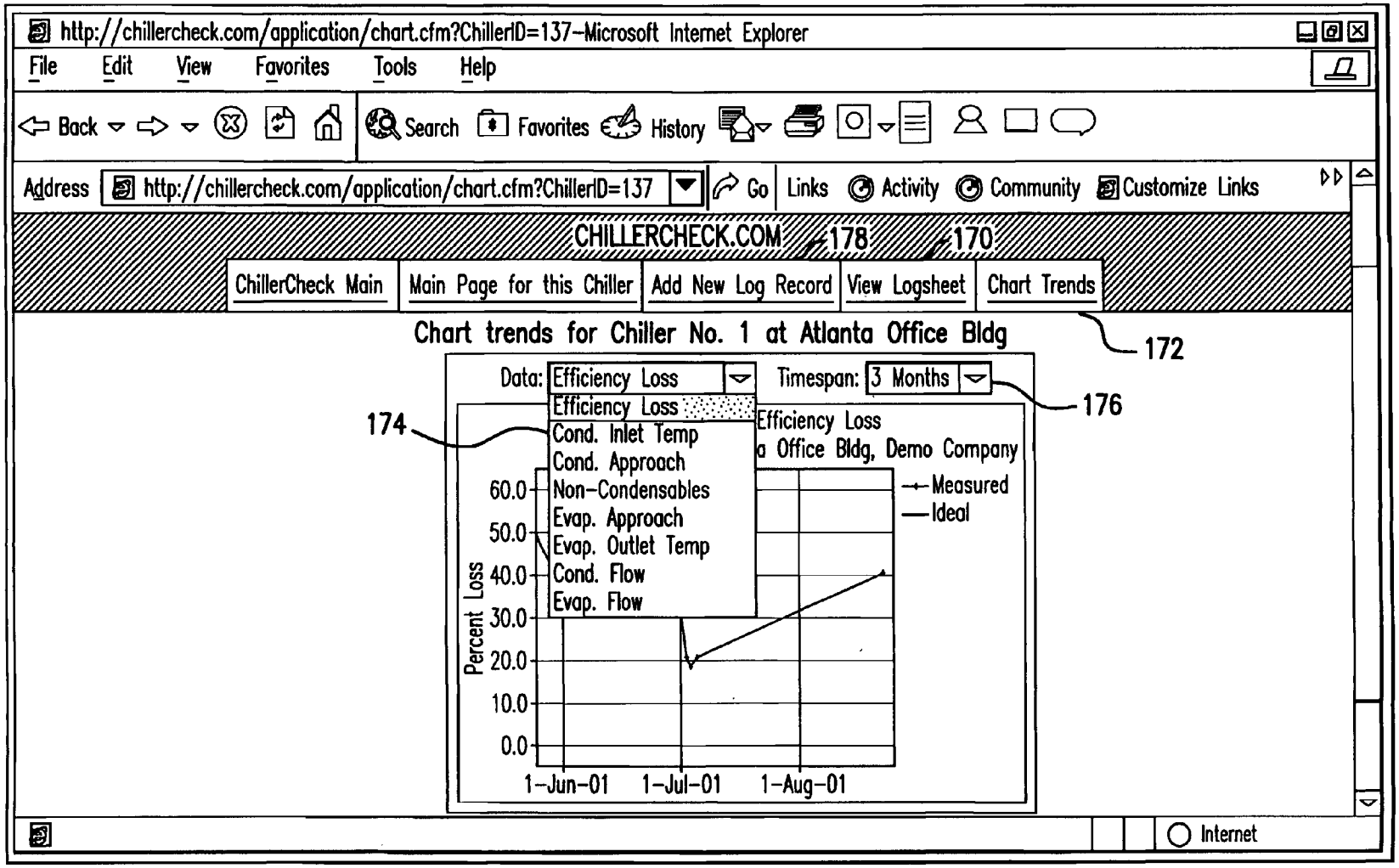
FIG. 10 depicts a chart for a selected chiller operating parameter.
Figure 11B:
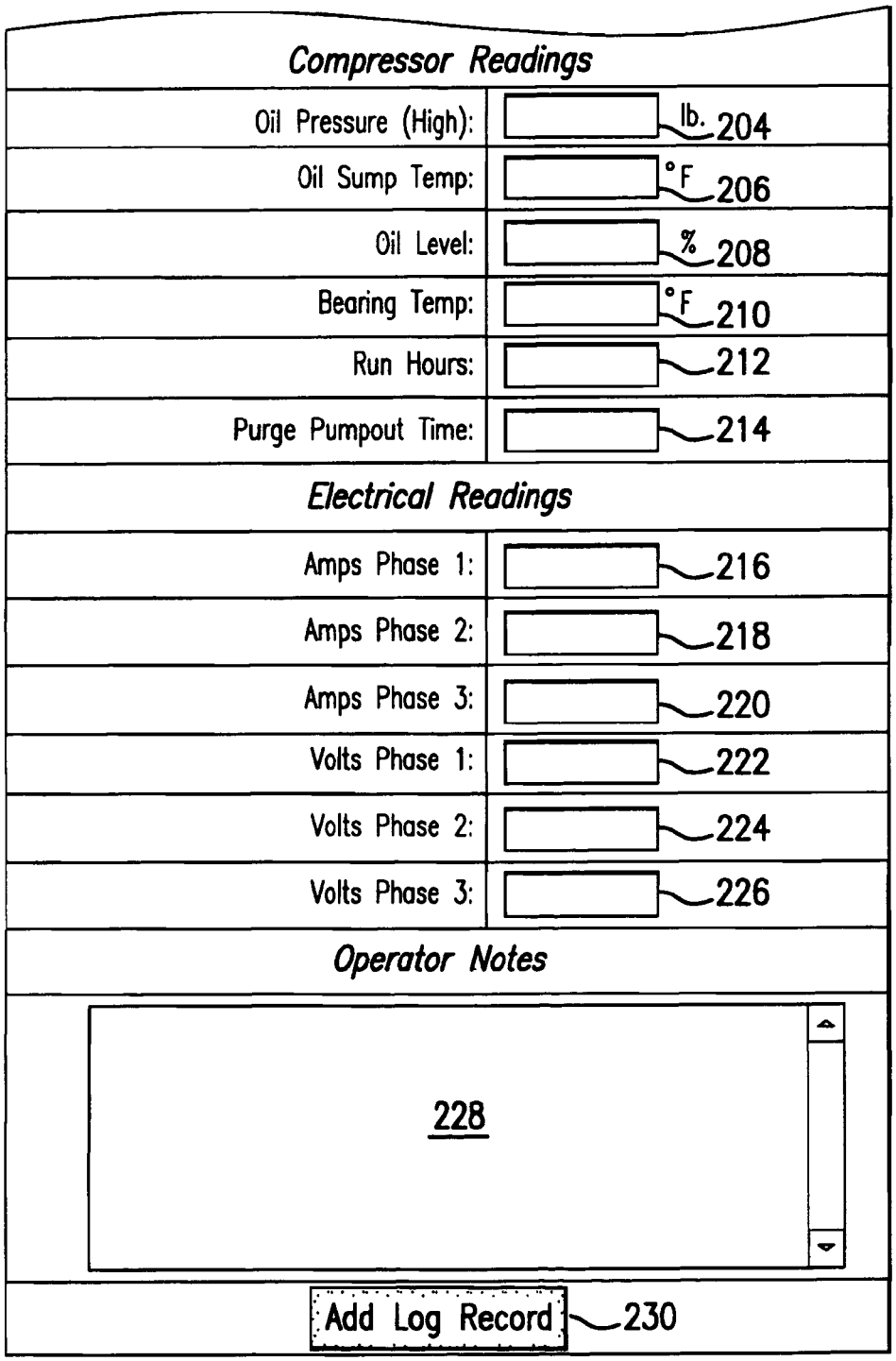
FIG. 11B is a continuation of FIG. 11A.

The user can initiate the computation of chiller efficiencies, as described above, by activating one of the "Calculate Efficiencies" hyperlinks 164 on the web page of FIG. 9 or by activating one of the hyperlinks on the web pages of FIGS. 7 and 8 that indicates the date and time a log record was created. In response, server 14 computes in accordance with the equations described above, the annual target cost to run the chiller, the annual actual cost to run the chiller, the difference between the target and actual costs (i.e., the cost of the efficiency loss), and the total efficiency loss percentage. As also described above with regard to the equations, server computer 14 determines which of the chiller components contributed to the efficiency loss and the percentage of the total it contributed. Server computer 14 transmits a web page such as that shown in FIG. 12 that contains the computed information to client computer 16. Note in the illustrated example that the web page includes two sections: A "Results" section that lists the "Target Cost to Run for Year," the "Actual Cost to Run for Year," the "Cost of Efficiency Loss" and the "Efficiency Loss" percentage; and a "Detailed Cost of Efficiency Loss" section that lists each identified problem, the percentage efficiency loss attributable to the problem, and the cost of the efficiency loss. In the example web page, two problems were identified: "Fouled Tubes–Condenser," which contributed 9.5% of the total efficiency loss, and "Non-Condensables–Condenser," which contributed 11.4% of the total efficiency loss. The web page further indicates that the annual cost (in dollars) of the 9.5% loss due to the condenser fouling problem was $5,187, and the annual cost of the 11.4% loss due to the non-condensables problem was $6,222. Thus, the owner or operator of the chiller could potentially save a total of $11,409 by fixing the identified problems.

Note that the web page also includes two "Fix It" hyperlinks 232, each relating to one of the identified problems. By activating one of hyperlinks 232, the user can receive the specific recommendations described above for further diagnosing the problem and servicing the chiller component to which the problem relates. For example, in response to activating the hyperlink 232 relating to the problem of non-condensables in the condenser, server computer 14 returns a suitable web page or window (not shown) that recommends the user take the steps described above to further diagnose and fix the problem:

1. Check instrumentation for accuracy and calibration.

If the instruments appear to be inaccurate, then recalibrate or replace instruments.

2. Check to insure liquid refrigerant is not building up in the condenser pressure gauge line. If it is, then blow down line or apply heat to remove liquid. A build-up of liquid in this line can add as much as 3 PSIG to the gauge reading, giving a false indication of non-condensables in the chiller.
3. Check purge for proper operation and purge count. If purge appears to be malfunctioning, turn on purge or repair purge if necessary. If purge frequency is excessive, leak test chiller.

Figure 13:
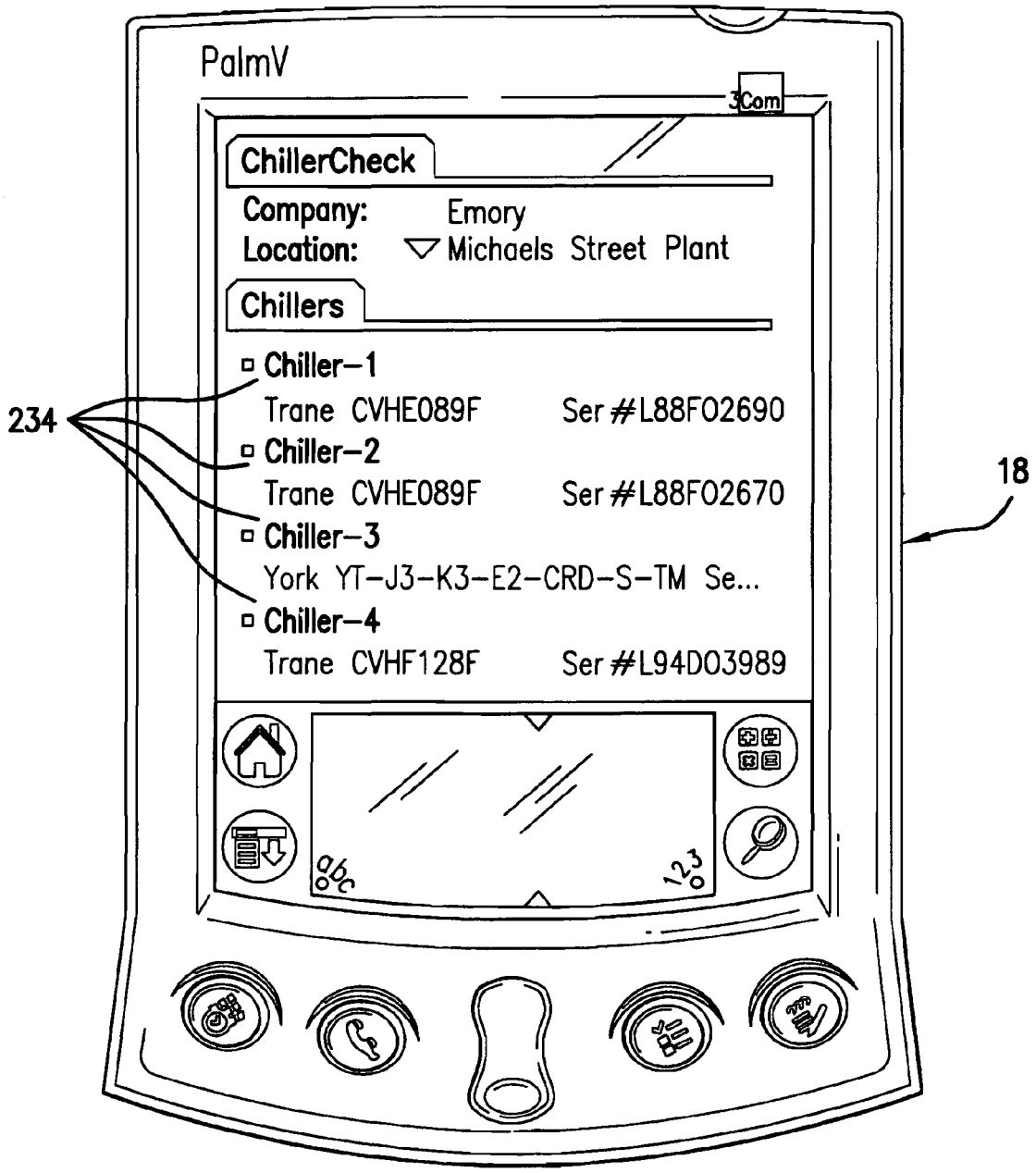
FIG. 13 depicts an initial screen of an alternative GUI displayed on a handheld data device.
Figure 14:
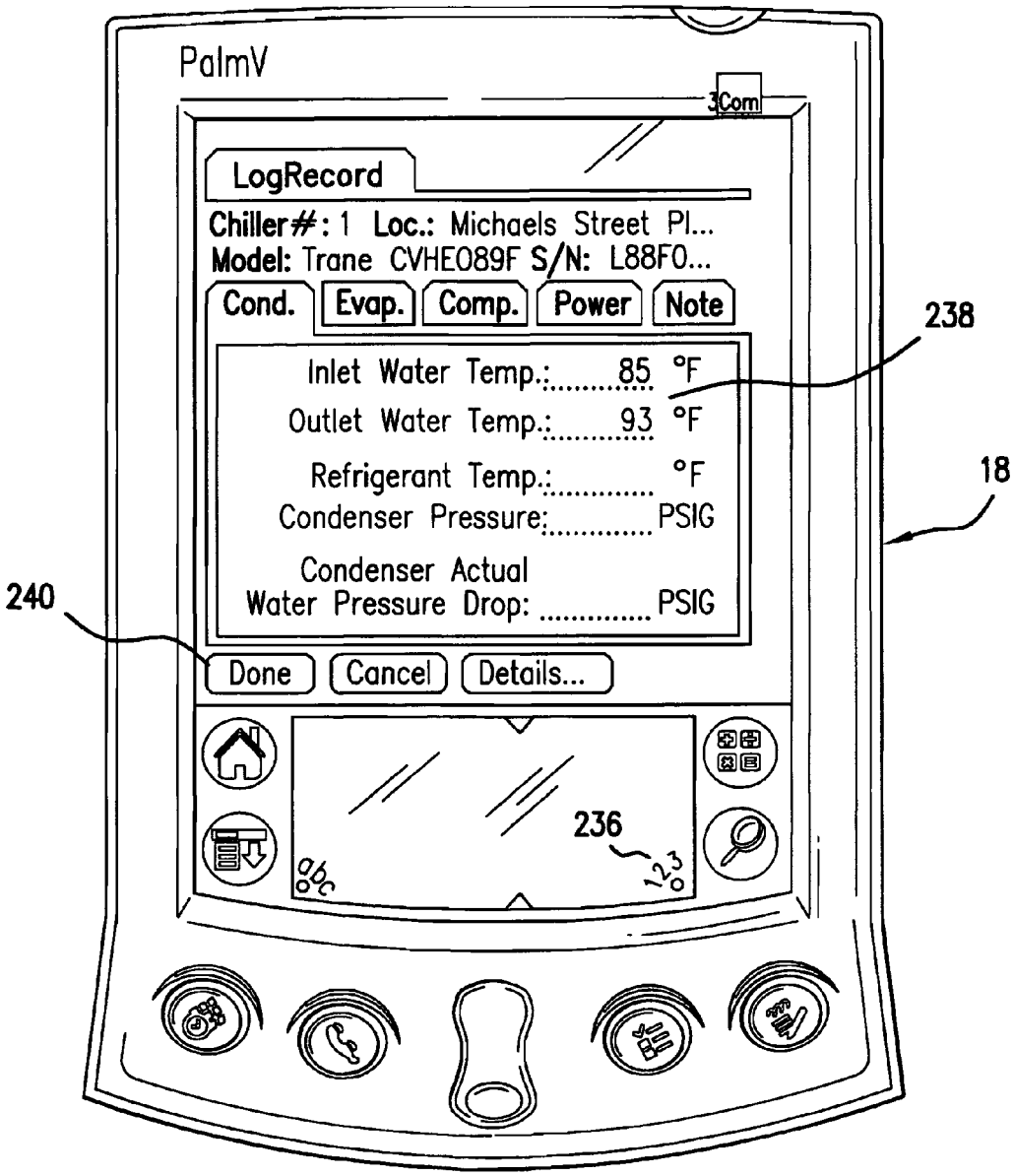
FIG. 14 depicts a screen of the alternative GUI via which a user can enter chiller readings into the handheld data device.
Figure 15:
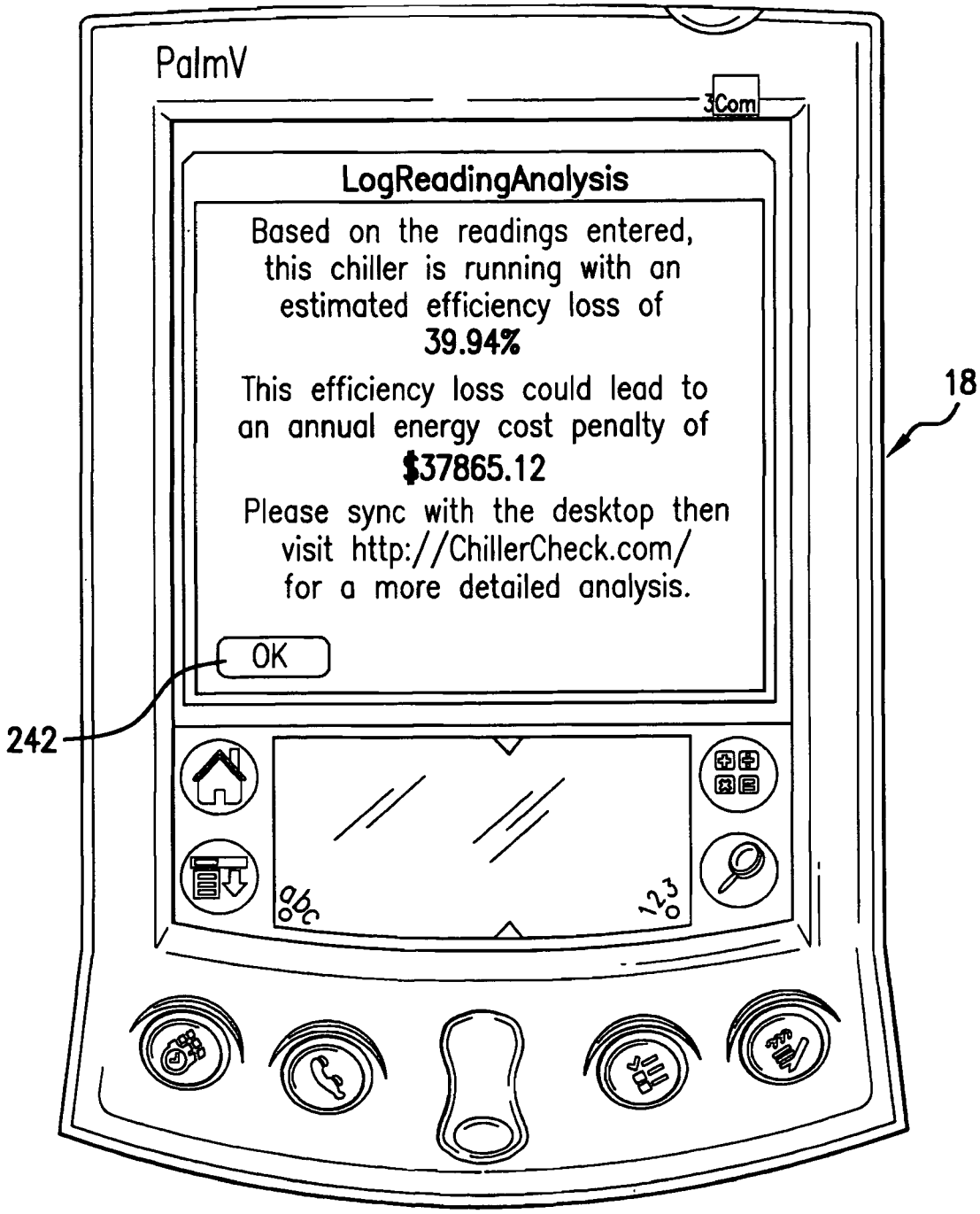
FIG. 15 depicts a screen of the alternative GUI showing the results of an efficiency loss computation for a selected chiller.
Figure 16A:
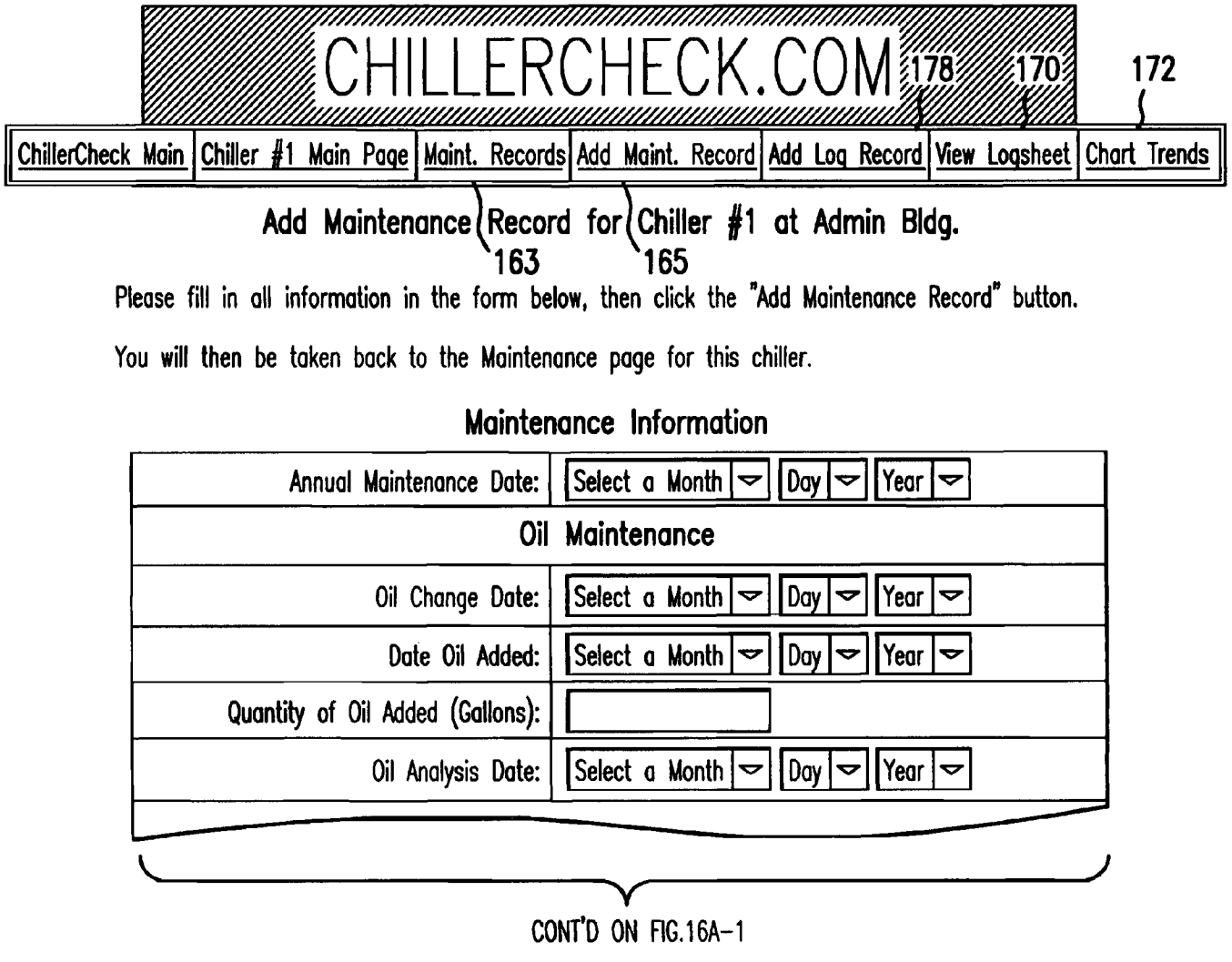
FIG. 16A depicts a screen via which a user can enter a chiller maintenance record.
Figure 16B:
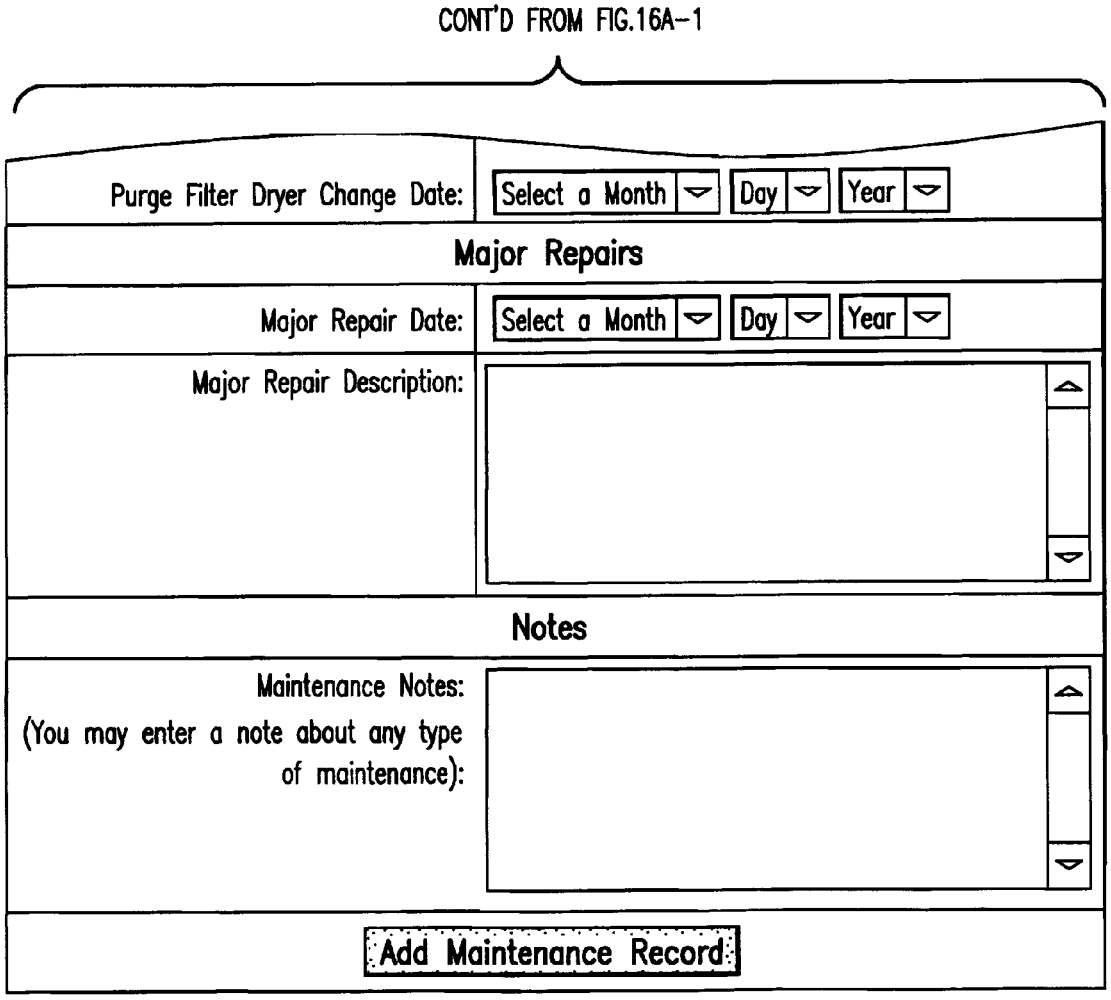
FIG. 16B is a continuation of FIG. 16A-1.

Although the use of the invention is described above from the perspective of a person using client computer 16 to communicate with server computer 14, it should be noted that in some embodiments of the invention handheld data device 18 can be used in addition to or in place of client computer 16. FIGS. 13, 14 and 15 illustrate some exemplary screen displays of a user interface suitable for such a device 18. Device 18 can be of the touch-screen type referred to as a "personal digital assistant" (PDA), such as the popular PALM® line of devices available from Palm, Inc. or similar devices available from Hewlett-Packard, Compaq and a variety of other companies, or it can be of a type more similar to a digital mobile telephone, a pager, a wireless e-mail terminal, or hybrids and variations of such devices.

Device 18 can be provided with suitable software to perform all or a subset of the computations and other functions described above with regard to those performed by server computer 14. The software can be that referred to above with regard to "Download PALM® Application" hyperlinik 90 (see FIGS. 5, 6A-6D and 7 to 7-1). In alternative embodiments, however, it can be provided with a browser program that allows it to be used in the same manner as client computer 16, exchanging information with server computer 14 using the hypertext transfer protocol of the World Wide Web or a similar protocol. In the illustrated embodiment, device 18 performs a subset of the computations and functions performed by server computer 14 and can be docked or synchronized (sometimes referred to in the art as "hot syncing") with client computer 16 to allow a user to integrate its functions with those the user can perform using client computer 16 as described above. Thus, a user can take device 18 to a site at which chillers are installed, read the chiller instruments and input the measured parameters into device 18, and have device 18 perform some of the computations described above. The user can then return to his or her office and sync device 18 with a desktop computer such as client computer 16 to perform any additional computations that may only be available via server computer 14. Also, the log record created by the user inputting the measured parameters can be uploaded to the database maintained by server 14.

As illustrated in FIG. 13, a main page or screen display can be displayed that is similar to the web page described above with regard to FIG. 5. This screen display lists a number of chillers at a selected site. The user can select a chiller by touching the screen on the chiller name 234. In response, device 18 produces a screen display such as that of FIG. 14. By touching the screen on the numeric-entry button 236, the user can enter measured chiller parameters 238. When the user has entered all parameters 238, the user touches the screen on the "Done" button 240. In response, device 18 produces a screen display such as that of FIG. 15. This screen displays a chiller efficiency loss, if any, and associated annual energy cost, computed as described above with regard to the equations. Touching the screen on the "OK" button 242 returns to the main screen of FIG. 14. Device 18 can be provided with additional functions, including all those described above with regard to server 14, such as recommending service of specific chiller components; FIGS. 13-15 are therefore intended to be merely illustrative and not limiting.

It will be apparent to those skilled in the art that various modifications and variations can be made in the present invention without departing from the scope or spirit of the invention. Other embodiments of the invention will be apparent to those skilled in the art from consideration of the specification and practice of the invention disclosed herein. It is intended that the specification and examples be considered as exemplary only, with a true scope and spirit of the invention being indicated by the following claims.

What is claimed is:

1. A method for evaluating the performance of an air conditioning chiller having a compressor and a plurality of components including a condenser and an evaporator, comprising the steps of:

A. receiving performance data for the compressor and each of the plurality of components;

B. for each of the plurality of components, calculating a component loss value using at least one of a plurality of relationships correlating performance data with an efficiency loss;

C. calculating a chiller loss value based on at least one of the component loss values; and D. determining for each of the plurality of components whether that component has a significant effect upon air conditioning chiller efficiency by comparing the component loss value for that component to a component loss threshold value associated with that component.

2. The method of claim 1, further comprising the step of:

E. identifying at least one of the plurality of components that is reducing the efficiency of the air conditioning chiller.

3. The method of claim 2, further comprising the step of:

F. identifying at least one potential cause of the reduction in the efficiency of the air conditioning chiller identified in step D.

4. The method of claim 3, further comprising the step of

G. identifying a potential solution to the at least one potential cause of the reduction in efficiency of the air conditioning chiller identified in step E.

5. The method of claim 1, further comprising the step of:

E. performing steps A-C for a second air conditioning chiller that along with the air conditioning chiller defines a group of two or more monitored chillers.

6. The method of claim 1, further comprising the step of:

E. calculating an energy cost based on the chiller loss value calculated in step C.

7. The method of claim 1, further comprising the step of:

E. receiving a full load current of the compressor and a running current of the compressor;

F. receiving information sufficient to define an expected condenser approach; and in which the performance data for the condenser comprises:

i. a condenser refrigerant temperature, ii. a condenser outlet temperature; and in which step B further comprises, calculating the component loss value for the condenser by performing steps comprising:

i. calculating a fractional current by dividing the running current of the compressor by a full load current of the compressor, ii calculating a full load condenser approach by subtracting the condenser outlet temperature from the condenser refrigerant temperature and dividing the result by the fractional current, iii. if the full load condenser approach is greater than the expected condenser approach, calculating a condenser approach difference by subtracting the expected condenser approach from the full load condenser approach, and iv. multiplying the condenser approach difference by a condenser approach loss factor to result in the component loss value for the condenser.

8. The method of claim 7, in which the expected condenser approach is selected from the group consisting: of an estimated condenser approach based on when the chiller was made and an optimal condenser approach.

9. The method of claim 1, further comprising the step of:

E. receiving information sufficient to define an optimal condenser pressure and;

in which the performance data for the condenser comprises a condenser pressure; and in which step B further comprises, calculating the component loss value for the condenser by subtracting the optimal condenser pressure from the condenser pressure and multiplying the result by a non-condensables constant based upon the type of refrigerant used in the air conditioning chiller and the units in which condenser pressure is received.

10. The method of claim 1, further comprising the step of:

E. receiving information sufficient to define an optimal condenser pressure drop and;

in which the performance data for the condenser comprises:

i. an condenser inlet water pressure, ii an condenser outlet water pressure, iii. an condenser inlet water temperature, iv. an condenser outlet water temperature, and in which step B further comprises, calculating the component loss value for the condenser by:

i. subtracting condenser outlet water pressure from the condenser inlet water pressure to define an actual condenser water pressure difference, ii. taking the square root of the ratio of the actual condenser water pressure difference to the optimal condenser water pressure drop to define a delta variance.

iii. subtracting the condenser inlet water temperature from the condenser outlet water temperature to define a condenser water temperature difference.

iv. subtracting delta variance from one and multiplying the result by the condenser water temperature difference to define a final variance.

v. multiplying the final variance by a condenser flow loss factor to result in the component loss value for the condenser.

11. The method of claim 1, further comprising the step of:

E. receiving a full load current of the compressor, a running current of the compressor, and an optimal evaporator approach; and in which the performance data for the evaporator comprises:

i. an evaporator refrigerant temperature, ii. a chill water outlet temperature, in which step B further comprises, calculating the component loss value for the evaporator by performing steps comprising:

i. calculating a fractional current by dividing the running current of the compressor by a full load current of the compressor, ii. calculating a full load evaporator approach by subtracting the chill water outlet temperature from the evaporator refrigerant temperature and dividing the result by the fractional current, iii. if the full load evaporator approach is greater than the optimal evaporator approach, calculating a evaporator approach difference by subtracting the optimal evaporator approach from the full load evaporator approach, and iv. multiplying the evaporator approach difference by a evaporator approach loss factor to result in the component loss value for the evaporator.

12. The method of claim 1, further comprising the step of reading instruments measuring condenser parameters and in which:

the receiving step comprises receiving the performance data for the condenser based upon the condenser parameters; and steps B and C are performed by a computing device.

13. The method of claim 1, further comprising the step of reading instruments measuring condenser parameters and in which the receiving step comprises receiving by a portable handheld device the performance data for the condenser based upon the condenser parameters, and further comprising the step of:

E. sending the performance data for the condenser to a computing device that performs steps B and C.

14. The method of claim 1, further comprising the steps of:

E. reading with a portable handheld device the performance data for the condenser from a plurality of sensors that measure at least one condenser parameter, and F. sending the performance data for the condenser to a computing device and in which steps B and C are performed by the computing device.

15. The method of claim 1, and further comprising the step of storing the calculated chiller loss value.

16. The method of claim 1, and further comprising the step of outputting the calculated chiller loss value.

17. The method of claim 16, wherein the outputting step comprises outputting the calculated chiller loss value to a display device.

18. The method of claim 1, and further comprising the step of generating an output signal comprising a signal representative of the calculated chiller loss value.

19. A method of evaluating the performance of a condenser of an air conditioning chiller having a compressor, comprising the steps of:

A. receiving chiller data, comprising:

i. an expected condenser approach, ii. a compressor running current, iii. a full load compressor current, iv. a condenser refrigerant temperature, and v. a condenser outlet water temperature;

B. determining a condenser loss value by calculating:

i. a fractional current by dividing the compressor running current by a full load compressor current, ii. a full load condenser approach by subtracting the condenser outlet water temperature from the condenser refrigerant temperature and dividing the result by the fractional current, iii. a condenser approach difference if the full load condenser approach is greater than the expected condenser approach by subtracting the expected condenser approach from the full load condenser approach, and iv. multiplying the condenser approach difference by a condenser approach loss factor to result in the condenser loss value.

20. The method of claim 19, in which the expected condenser approach is selected from the group consisting of an estimated condenser approach based on when the chiller was made and an optimal condenser approach.

21. The method of claim 19, further comprising the step of:

C. determining whether the condenser loss value represents a significant reduction in the efficiency of the air conditioning chiller by comparing the condenser loss value to a condenser loss threshold value.

22. The method of claim 19, further comprising the step of:

C. calculating an energy cost based on the condenser loss value determined in step B.

23. The method of claim 19, and further comprising the step of storing the determined condenser loss value.

24. The method of claim 19, and further comprising the step of outputting the determined condenser loss value.

25. The method of claim 24, wherein the outputting step comprises outputting the calculated condenser loss value to a display device.

26. The method of claim 19, and further comprising the step of generating an output signal comprising a signal representative of the condenser chiller loss value.

27. One or more computer readable media containing instructions that when executed by a computer perform the method of claim 19.

28. A system for evaluating the performance of an air conditioning chiller having a compressor and a plurality of components including a condenser and an evaporator, comprising:

A. means for receiving performance data for the compressor and each of the plurality of components;

B. means for calculating for each of the plurality of components a component loss value using at least one of a plurality of relationships correlating performance data with an efficiency loss;

C. means for calculating a chiller loss value based on at least one of the component loss values;

D. means for determining for each of the plurality of components whether the has significant effect air conditioning efficiency by comparing the component loss value for the component to a component loss threshold value associated with the component; and E. means for identifying at least one of the plurality of components that is reducing the efficiency of the air conditioning chiller.

* * * * *

UNITED STATES PATENT AND TRADEMARK OFFICE

CERTIFICATE OF CORRECTION

PATENT NO. : 7,349,824 B2
APPLICATION NO. : 11/183582
DATED : March 25, 2008
INVENTOR(S) : Seigel It is certified that error appears in the above-identified patent and that said Letters Patent is hereby corrected as shown below:

Claim 3 at column 20, line 28, delete “step D” and insert --step E--.
Claim 4 at column 20, line 32, delete “step E” and insert --step F--.
Claim 7 at column 20, lines 52-53, delete “a full load current of the compressor” and insert --the full load current of the compressor--.
Claim 10 at column 21, line 20, delete “an” and insert --a--.
Claim 10 at column 21, line 21, delete “an” and insert --a--.
Claim 10 at column 21, line 22, delete “an” and insert --a--.
Claim 10 at column 21, line 23, delete “an” and insert --a--.
Claim 10 at column 21, line 32, delete the period (“.”) and insert a comma (--,--).
Claim 10 at column 21, line 35, delete the period (“.”) and insert a comma (--,--).
Claim 11 at column 21, lines 54-55, delete “a full load current of the compressor” and insert --the full load current of the compressor--.
Claim 11 at column 21, lines 65-66, delete “a evaporator” and insert --an evaporator--.
Claim 19 at column 22, line 50, delete “a full load compressor current” and insert --the full load compressor current--.
Claim 26 at column 23, line 20, delete “condenser chiller loss value” and insert --condenser loss value--.
Claim 28 at column 24, line 14, delete “whether the has significant effect” and insert --whether the component has significant effect--.

Signed and Sealed this

Nineteenth Day of August, 2008

JON W. DUDAS
*Director of the United States Patent and Trademark Office*